US011460224B2

(12) United States Patent
Saunders et al.

(10) Patent No.: US 11,460,224 B2
(45) Date of Patent: Oct. 4, 2022

(54) OIL CONTROL FOR CLIMATE-CONTROL SYSTEM

(71) Applicant: Emerson Climate Technologies, Inc., Sidney, OH (US)

(72) Inventors: Michael A. Saunders, Sidney, OH (US); Kory M. Place, Sidney, OH (US); James Scott Fraser, Springboro, OH (US); Natarajan Rajendran, Centerville, OH (US); Jason A. Born, Cincinnati, OH (US); Daniel J. Rice, Sidney, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 0 days.

(21) Appl. No.: 16/668,603

(22) Filed: Oct. 30, 2019

(65) Prior Publication Data

US 2020/0132346 A1 Apr. 30, 2020

Related U.S. Application Data

(60) Provisional application No. 62/875,150, filed on Jul. 17, 2019, provisional application No. 62/753,526, filed on Oct. 31, 2018.

(51) Int. Cl.
*F25B 31/00* (2006.01)
*F25B 49/02* (2006.01)
(Continued)

(52) U.S. Cl.
CPC ..... *F25B 5/02* (2013.01); *F25B 31/004* (2013.01); *F25B 41/20* (2021.01); *F25B 41/24* (2021.01);
(Continued)

(58) Field of Classification Search
CPC ..... F25B 31/004; F25B 49/022; F25B 2600/2519; F25B 2600/0251; F25B 1/10;
(Continued)

(56) References Cited

U.S. PATENT DOCUMENTS 2,042,394 A * 5/1936 Gay ..... F25B 31/004 62/84
3,785,169 A * 1/1974 Gylland, Jr. ..... F04B 39/06 62/468
(Continued)

FOREIGN PATENT DOCUMENTS

CN 105008824 A 10/2015
CN 105593610 A 5/2016
(Continued)

OTHER PUBLICATIONS

International Search Report regarding International Application No. PCT/US2019/059128, dated May 18, 2020.
(Continued)

*Primary Examiner* — Kun Kai Ma
(74) *Attorney, Agent, or Firm* — Harness, Dickey & Pierce, P.L.C.

(57) ABSTRACT

Systems and methods for purging lubricant from a first compressor to a second compressor are provided. A control module receives a lubricant purge command, shuts the second compressor to an OFF-mode while the first compressor remains in the ON-mode, restricts working fluid from an outlet of the second compressor from flowing into the first compressor and allows compressed working fluid discharged from an outlet of the first compressor to flow into the inlet of the second compressor such that lubricant in the second compressor flows into the first compressor.

54 Claims, 30 Drawing Sheets

(51) Int. Cl.
*F25B 5/02* (2006.01)
*F25B 41/20* (2021.01)
*F25B 41/24* (2021.01)

(52) U.S. Cl.
CPC .... *F25B 49/022* (2013.01); *F25B 2600/2519* (2013.01)

(58) Field of Classification Search
CPC ..... F25B 49/02; F25B 41/40; F25B 41/20; F25B 2400/075
See application file for complete search history.

(56) References Cited

U.S. PATENT DOCUMENTS 4,383,802 A * 5/1983 Gianni ..... F01M 11/12 417/12
4,418,548 A * 12/1983 Sawyer ..... F04B 41/00 137/513.7
4,741,674 A * 5/1988 Tischer ..... F25B 41/20 417/295
4,870,831 A * 10/1989 Kitamoto ..... F25B 31/002 62/84
5,369,958 A * 12/1994 Kasai ..... F24F 3/065 62/158
5,996,363 A * 12/1999 Kurachi ..... F04B 39/0207 62/192
6,170,286 B1 1/2001 Keuper
6,276,148 B1 * 8/2001 Shaw ..... F04B 9/04 237/2 B
2003/0156939 A1 * 8/2003 Evans ..... F04B 41/00 415/26
2009/0007588 A1 * 1/2009 Shaw ..... F25B 31/002 62/470
2010/0206000 A1 * 8/2010 Jeong ..... F25B 31/004 62/470
2010/0247331 A1 * 9/2010 Heinbokel ..... F04B 49/065 417/12
2011/0154839 A1 * 6/2011 Mihara ..... F25B 9/008 62/151
2011/0155816 A1 * 6/2011 Jeong ..... F25B 31/004 236/92 B
2011/0239667 A1 * 10/2011 Won ..... F25B 31/004 62/84
2011/0314845 A1 * 12/2011 Lifson ..... F25B 49/022 62/115
2012/0006041 A1 * 1/2012 Ikeda ..... F25B 31/004 62/193
2012/0312034 A1 12/2012 Oh et al.
2013/0136622 A1 * 5/2013 De Bernardi ..... F04B 39/0207 417/13
2013/0330210 A1 * 12/2013 Bonnefoi ..... F04C 23/008 417/62
2014/0238066 A1 * 8/2014 Perevozchikov ..... F04C 23/001 62/324.6
2015/0068229 A1 3/2015 Oh et al.
2017/0284706 A1 * 10/2017 Ozu ..... F25B 5/00
2018/0050578 A1 * 2/2018 Connell ..... B60H 1/00864
2018/0195781 A1 7/2018 Saunders et al.
2018/0298905 A1 * 10/2018 Scharer ..... F04B 39/0207
2018/0313581 A1 * 11/2018 Fredslund ..... F25B 41/20
2019/0301778 A1 * 10/2019 Ito ..... F25B 1/00

FOREIGN PATENT DOCUMENTS

CN 107709895 A 2/2018
EP 2221559 A1 8/2010
EP 3040643 A1 7/2016
JP 2004069213 A * 3/2004
KR 20160012383 A 2/2016
WO WO-2018180225 A1 10/2018

OTHER PUBLICATIONS

Written Opinion of the International Searching Authority regarding International Application No. PCT/US2019/059128, dated May 18, 2020.
International Preliminary Report on Patentability regarding International Application No. PCT/US2019/059128, dated Apr. 27, 2021.
First Office Action regarding Chinese Patent Application No. 201980078741.2, dated Mar. 29, 2022. Translation provided by Unitalen Attorneys at Law.

* cited by examiner

OIL CONTROL FOR CLIMATE-CONTROL SYSTEM

CROSS-REFERENCE TO RELATED APPLICATIONS

This application claims the benefit of U.S. Provisional Application No. 62/753,526, filed on Oct. 31, 2018 and U.S. Provisional Application No. 62/875,150, filed on Jul. 17, 2019. The entire disclosures of each of the above applications are incorporated herein by reference.

FIELD

The present disclosure relates to oil control for a climate-control system.

BACKGROUND

This section provides background information related to the present disclosure which is not necessarily prior art.

A climate-control system such as, for example, a heat-pump system, a refrigeration system, or an air conditioning system, may include a fluid circuit having an outdoor heat exchanger, one or more indoor heat exchangers, one or more expansion devices, and one or more compressors circulating a working fluid (e.g., refrigerant or carbon dioxide) through the fluid circuit. Efficient and reliable operation of the climate-control system is desirable to ensure that the climate-control system is capable of effectively and efficiently providing a cooling and/or heating effect on demand.

SUMMARY

This section provides a general summary of the disclosure, and is not a comprehensive disclosure of its full scope or all of its features.

In one form, the present disclosure provides a method including receiving a lubricant purge command for a climate-control system having first and second compressors; shutting the second compressor to an OFF-mode while the first compressor remains in an ON-mode in response to the lubricant purge command; restricting working fluid from an outlet of the second compressor from flowing into the first compressor; and allowing compressed working fluid discharged from an outlet of the first compressor to flow into an inlet of the second compressor such that lubricant in the second compressor flows into the first compressor.

In some configurations, the lubricant purge command is based on determining that the first compressor has a low lubricant level or the second compressor has a high lubricant level.

In some configurations, a first oil-management valve device is in fluid communication with the second compressor and a second oil-management valve device is in fluid communication with the second compressor.

In some configurations, the first and second oil-management valve devices are moved to an open position when the second compressor is shut to the OFF-mode.

In some configurations, a passageway is in fluid communication with the first and second oil-management valve devices. Lubricant flows from the second compressor into the first compressor via the passageway when compressed working fluid discharged from the outlet of the first compressor is allowed to flow into the inlet of the second compressor and the first and second oil-management valve devices are moved to the open position.

In some configurations, the first and second compressors are on a base plate.

In another form, the present disclosure provides a method including receiving a lubricant purge command for a climate-control system having first and second compressors; preventing working fluid exiting a condenser from flowing into an evaporator in response to the lubricant purge command; shutting the second compressor to an OFF-mode; drawing working fluid out of the evaporator using the first compressor and into a suction line in fluid communication with the evaporator and the first compressor; and shutting the first compressor to an OFF-mode such that lubricant flows from the first compressor into the second compressor.

In some configurations, the lubricant purge command is based on determining that the first compressor has a low lubricant level.

In some configurations, a first oil-management valve device is in fluid communication with the second compressor and a second oil-management valve device is in fluid communication with the second compressor.

In some configurations, the first and second oil-management valve devices are moved to an open position when the first compressor is shut to the OFF-mode.

In some configurations, a conduit is in fluid communication with the first and second compressors. Lubricant flows from the second compressor into the first compressor via the conduit when the first compressor is shut to the OFF-mode and the first and second oil-management valve devices are moved to the open position.

In some configurations, the first and second compressors are on a base plate.

In some configurations, compressed working fluid discharged from an outlet of the second compressor flows into an inlet of the first compressor.

In another form, the present disclosure provides a method including receiving a lubricant purge command for a climate-control system having first and second compressors; shutting the second compressor to an OFF-mode while the first compressor remains in an ON-mode in response to the lubricant purge command; allowing working fluid discharged from a condenser to flow into an inlet of the second compressor; and restricting working fluid from an outlet of the second compressor from flowing into the first compressor such that lubricant in the second compressor flows into the first compressor.

In some configurations, the lubricant purge command is based on determining that the first compressor has a low lubricant level or the second compressor has a high lubricant level.

In some configurations, a first fluid passageway extends from an evaporator to the first compressor. A second fluid passageway extends from a third fluid passageway at a location between the condenser and the evaporator to the inlet second compressor.

In some configurations, a first oil-management valve device is in fluid communication with the second compressor and is movable between open and closed positions.

In some configurations, an oil passageway extends from the first oil-management valve device to the first fluid passageway. Lubricant flows from the second compressor to the first compressor via the oil passageway when working fluid exiting the condenser is allowed to flow into the inlet of the second compressor via the second fluid passageway and working fluid from the second compressor is restricted from flowing into the first compressor.

In some configurations, the method includes positioning an accumulator along the second fluid passageway to remove liquid working fluid flowing into the inlet of the second compressor.

In another form, the present disclosure provides a method including receiving a lubricant purge command for a climate-control system having first and second compressors; restricting working fluid from an outlet of the second compressor from flowing into the first compressor in response to the lubricant purge command; shutting the second compressor to an OFF-mode while the first compressor remains in an ON-mode; and allowing working fluid in a discharge line of the second compressor to flow back into the second compressor such that lubricant in the second compressor flows into the first compressor.

In some configurations, the lubricant purge command is based on determining that the first compressor has a low lubricant level or the second compressor has a high lubricant level.

In some configurations, a fluid passageway extends from an evaporator to the first compressor.

In some configurations, an oil-management valve device is in fluid communication with the second compressor and is movable between open and closed positions.

In some configurations, an oil passageway extends from the oil-management valve device to the fluid passageway. Lubricant flows from the second compressor to the first compressor via the oil passageway when the second compressor is shut to the OFF-mode and working fluid in the discharge line of the second compressor is allowed to flow back into the second compressor.

In another form, the present disclosure provides a method including receiving a lubricant purge command for a climate-control system having first and second compressors; shutting the second compressor to an OFF-mode; preventing working fluid from an outlet of the second compressor from flowing into the first compressor; preventing working fluid from an evaporator from flowing into the first compressor; running the first compressor until the first compressor reaches a predetermined pressure setting; and shutting the first compressor to an OFF-mode after reaching the predetermined pressure setting such that lubricant flows from the second compressor into one of an oil separator and the first compressor.

In some configurations, the lubricant purge command is based on determining that the second compressor has a high lubricant level.

In some configurations, lubricant flows from the second compressor into the oil separator.

In some configurations, an oil-management valve device is in fluid communication with the second compressor and is movable between open and closed positions. The oil-management valve device is moved from the closed position to the open position after the second compressor is shut to the OFF-mode.

In some configurations, an oil passageway extends from the oil-management valve device to the oil separator disposed along a discharge line of the second compressor. Lubricant flows from the second compressor to the oil separator via the oil-management valve device and the oil passageway.

In some configurations, the oil separator is a bi-directional oil separator.

In some configurations, lubricant flows from the second compressor into the first compressor.

In some configurations, a fluid passageway extends from the evaporator to the first compressor. A discharge line extends from the outlet of the second compressor to the fluid passageway.

In some configurations, an oil-management valve device is in fluid communication with the second compressor and is movable between open and closed positions. The oil-management valve device is moved from the closed position to the open position after the second compressor is shut to the OFF-mode.

In some configurations, an oil passageway extends from the oil-management valve device to the discharge line. Lubricant flows from the second compressor to the first compressor via the oil-management valve device, the oil passageway, and the fluid passageway.

In another form, the present disclosure provides a method that includes receiving a lubricant purge command for a climate-control system having first and second compressors; shutting the second compressor to an OFF-mode while the first compressor remains in an ON-mode in response to the lubricant purge command; allowing working fluid discharged from a condenser to flow into an inlet of the second compressor; and restricting working fluid from an outlet of the second compressor from flowing into the first compressor such that lubricant in the second compressor flows into an oil separator.

In some configurations, the lubricant purge command is based on determining that the second compressor has a high lubricant level.

In some configurations, an oil-management valve device is in fluid communication with the second compressor and is movable between open and closed positions. The oil-management valve device is moved from the closed position to the open position after the second compressor is shut to the OFF-mode.

In some configurations, an oil passageway extends from the oil-management valve device to the oil separator disposed along a discharge line of the second compressor. Lubricant flows from the second compressor to the oil separator via the oil-management valve device and the oil passageway.

In some configurations, the oil separator is a bi-directional oil separator.

In some configurations, a first fluid passageway extends from a second fluid passageway at a location between the condenser and an evaporator to the inlet of the second compressor.

In some configurations, the method further includes positioning an accumulator along the first fluid passageway to remove liquid working fluid from flowing into the inlet of the second compressor.

In another form, the present disclosure provides a method that includes receiving a lubricant purge command for a climate-control system having first and second compressors; shutting the second compressor to an OFF-mode; selectively allowing working fluid discharged from a condenser to flow into an evaporator; preventing working fluid from an outlet of the second compressor from flowing into the first compressor; and heating the evaporator such that lubricant in the second compressor flows into an oil separator.

In some configurations, an oil-management valve device is in fluid communication with the second compressor and is movable between open and closed positions. The oil-management valve device is moved from the closed position to the open position when the second compressor is shut to the OFF-mode.

In some configurations, an oil passageway extends from the oil-management valve device to the oil separator disposed along a discharge line of the second compressor, and wherein lubricant flows from the second compressor to the oil separator via the oil-management valve device and the oil passageway.

In some configurations, the oil-management valve device is held in the open position for a predetermined time period or until the pressure in a suction line of the second compressor exceeds a predetermined value.

In some configurations, the oil separator is a bi-directional oil separator.

In some configurations, working fluid discharged from the condenser is prevented from flowing into the evaporator when the second compressor is shut to the OFF-mode if pressure in the evaporator is above a predetermined value.

In some configurations, working fluid discharged from the condenser is allowed to flow into the evaporator when the second compressor is shut to the OFF-mode if pressure in the evaporator is below a predetermined value.

In some configurations, working fluid discharged from the condenser is allowed to flow into the evaporator after or before heating the evaporator.

In some configurations, working fluid discharged from the condenser is allowed to flow into the evaporator for a predetermined period of time.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
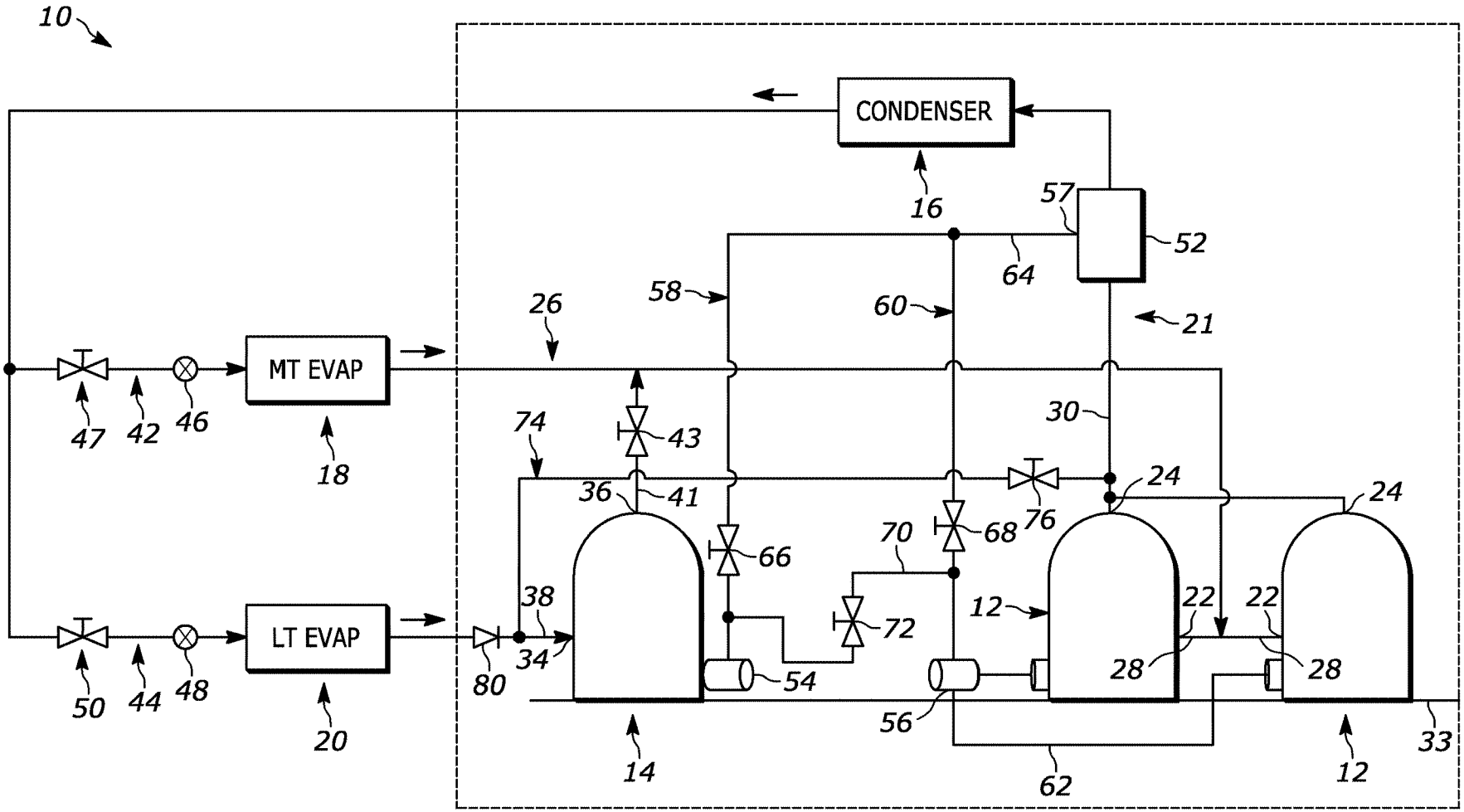
FIG. 1 is a schematic representation of a climate-control system according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
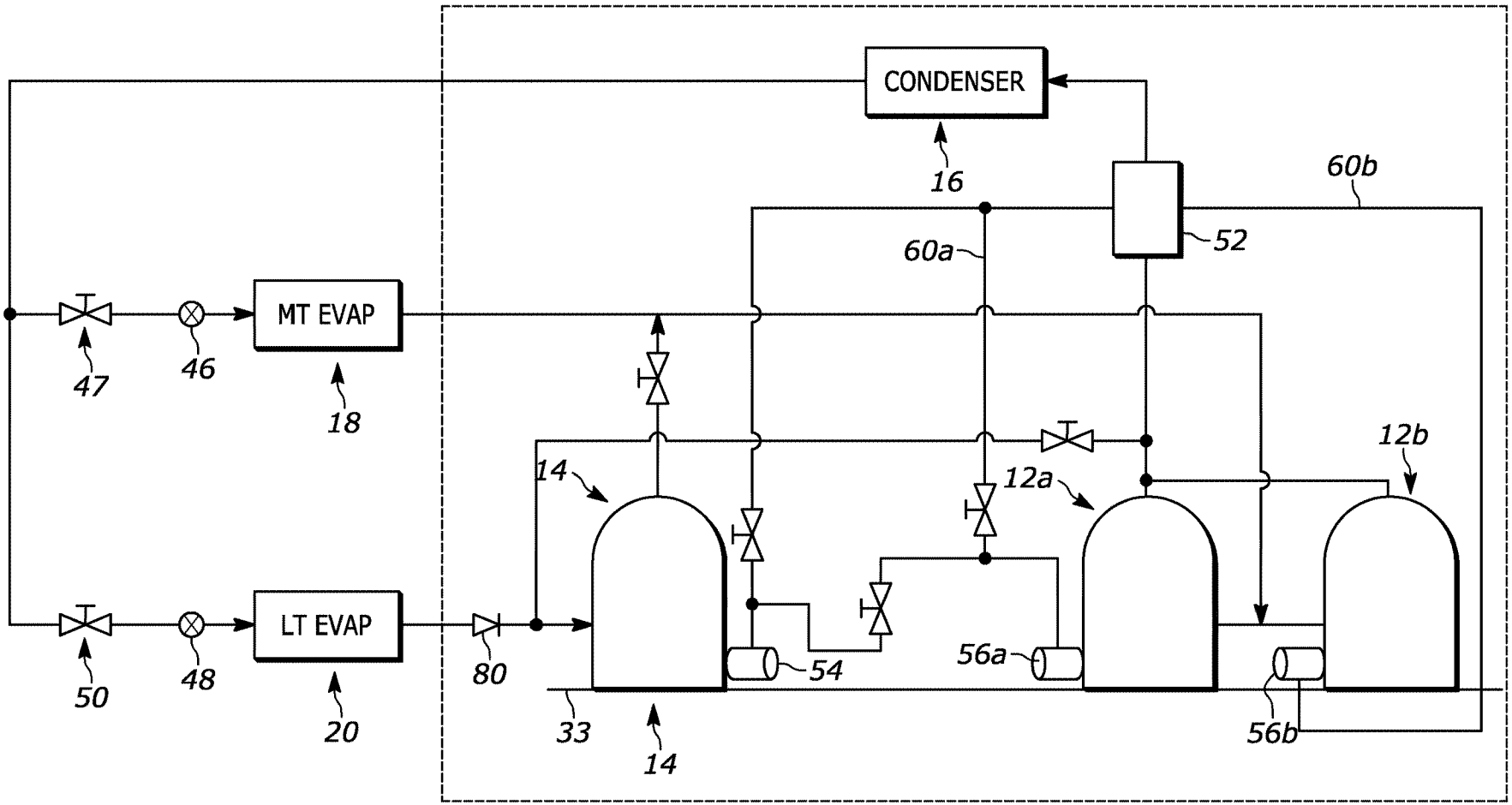
FIG. 2 is another schematic representation of a climate-control system.

With reference to FIGS. 1 and 2, a climate-control system 10 is provided that may include a fluid-circuit having one or more first compressors 12, one or more second compressors 14, a first heat exchanger 16 (an outdoor heat exchanger such as a condenser or gas cooler, for example), a second heat exchanger 18, (an indoor heat exchanger such as a medium-temperature evaporator, for example) a third heat exchanger 20 (an indoor heat exchanger such as a low-temperature evaporator, for example), an oil apparatus 21 and a control module 23. The one or more first compressors 12 and/or the one or more second compressors 14 may pump working fluid (e.g., refrigerant, carbon dioxide, etc.) through the circuit.

Each first compressor 12 may be a low-side compressor (i.e., a compressor in which the motor assembly is disposed within a suction-pressure chamber within the shell), for example, and may be any suitable type of compressor such as a scroll, rotary, reciprocating or screw compressor, for example. Each first compressor 12 may have an inlet 22 (e.g., a first inlet fitting) and an outlet 24 (e.g., an outlet fitting). The inlet 22 may provide fluid to a compression mechanism (not shown). A first fluid passageway 26 may extend from the second heat exchanger 18 to the inlets 22 of first compressors 12 via suction lines 28. In this manner, working fluid exiting the second heat exchanger 18 may flow into each first compressor 12 (via a respective inlet 22 and suction line 28) to be compressed by the compression mechanisms of the first compressors 12. After the working fluid is compressed by the compression mechanisms of the first compressors 12, the working fluid can be discharged from the first compressors 12 through the outlets 24 to a discharge line 30

In some configurations, each first compressor 12 could be a high-side compressor (i.e., a compressor in which the motor assembly is disposed within a discharge-pressure chamber within the shell). In some configurations, each of the first compressors 12 may have different capacities than one another or than the one or more second compressors 14. In some configurations, one or more of the first compressors 12 or one or more of the second compressors 14 may include a fixed-speed or variable-speed motor.

The second compressor 14 may adjacent to the first compressors 12 on a single base plate 33. The second compressor 14 may be a low-side compressor (i.e., a compressor in which the motor assembly is disposed within a suction-pressure chamber within the shell), for example, and may be any suitable type of compressor such as a scroll, rotary, reciprocating or screw compressor, for example. The second compressor 14 may have an inlet 34 (e.g., a first inlet fitting) and an outlet 36 (e.g., an outlet fitting). The inlet 34 may provide fluid to a compression mechanism (not shown). A suction line 38 may be fluidly coupled to the inlet 34 of the second compressor 14. In this manner, working fluid exiting the third heat exchanger 20 may flow into the second compressor 14 (via the suction line 38 and the inlet 34) to be compressed by the compression mechanism of the second compressor 14. After the working fluid is compressed by the compression mechanism of the second compressor 14, the working fluid can be discharged from the second compressor 14 through the outlet 36 and into the first fluid passageway 26 (via a discharge line 41) where it mixes with the working fluid exiting the second heat exchanger 18. In some configurations, the second compressor 14 could be a high-side compressor (i.e., a compressor in which the motor assembly is disposed within a discharge-pressure chamber within the shell).

A first valve 43 may be disposed along the discharge line 41 of the second compressor 14 and may be movable between an open position in which compressed working fluid discharged from the second compressor 14 is allowed to flow to the suction line 28 and a closed position in which compressed working fluid discharged from the second compressor 14 is prevented from flowing to the suction line 28. It will be appreciated that the first valve 43 could be a solenoid valve, a mechanical valve actuated by fluid-pressure differentials, or an electronic expansion valve, for example, or any other type of valve.

The first heat exchanger 16 may receive compressed working fluid from the first compressors 14 via the discharge line 30 and the oil apparatus 21, and may transfer heat from the compressed working fluid to ambient air that may be forced over the first heat exchanger 16 by a fan (not shown). In some configurations, the first heat exchanger 16 may transfer heat from the compressed working fluid to a stream of liquid such as water, for example. From the first heat exchanger 16, a first portion of the working fluid flows into a second fluid passageway 42 and a second portion the working fluid may flow through a third fluid passageway 44.

The second fluid passageway 42 may include a first expansion device 46 (e.g., an electronic expansion valve, a thermal expansion valve or capillary tube) and the second heat exchanger 18. The working fluid in the second fluid passageway 42 flows through the first expansion device 46 where its temperature and pressure is lowered. In the second heat exchanger 18, the working fluid may absorb heat from a first space to be cooled (e.g., an interior of a refrigerator, a refrigerated display case, or a cooler). From the second heat exchanger 18, the working fluid flows to the first fluid passageway 26 and into the first compressors 12 via the suction lines 28 and inlets 22.

A second valve 47 may be disposed along the second fluid passageway 42 at a location upstream of the first expansion device 46 and may be movable between an open position in which working fluid is allowed to flow through the second fluid passageway 42 and a closed position in which working fluid is prevented from flowing through the second fluid passageway 42. It will be appreciated that the first valve 47 could be a solenoid valve, a mechanical valve actuated by fluid-pressure differentials, or an electronic expansion valve, for example, or any other type of valve.

The third fluid passageway 44 may include a second expansion device 48 (e.g., an electronic expansion valve, a thermal expansion valve or capillary tube) and the third heat exchanger 20. The working fluid in the third fluid passageway 44 flows through the second expansion device 48 where its temperature and pressure is lowered. In the third heat exchanger 20, the working fluid may absorb heat from a second space to be cooled (e.g., freezer or a frozen food display case). In some configurations, the working fluid in the second heat exchanger 18 of the second fluid passageway 42 and the working fluid in the third heat exchanger 20 of the third fluid passageway 44 may absorb heat from the same space (e.g., the second heat exchanger 18 of the second fluid passageway 42 and the third heat exchanger 20 of the third fluid passageway 44 may operate at different times to switch the space between a freezer and a cooler, for example). From the third heat exchanger 20, the working fluid flows into the second compressor 14 via the suction line 38 and the inlet 34.

A third valve 50 may be disposed along the third fluid passageway 44 at a location upstream of the second expansion device 48 and may be movable between an open position in which working fluid is allowed to flow through the third fluid passageway 44 and a closed position in which working fluid is prevented from flowing through the third fluid passageway 44. It will be appreciated that the third valve 50 could be a solenoid valve, a mechanical valve actuated by fluid-pressure differentials, or an electronic expansion valve, for example, or any other type of valve.

The oil apparatus 21 may include an oil separator 52, first and second oil-management valve devices 54, 56, a first oil passageway 58 and a second oil passageway 60. The oil separator 52 is disposed along the discharge line 30 such that compressed working fluid discharged from the first compressors 12 passes through the oil separator 52 and the lubricant (e.g., oil) therein is entrapped in the oil separator 52. The first oil-management valve device 54 is attached to the second compressor 14 and is in fluid communication with an internal cavity (not shown) of the second compressor 14. The device 54 monitors the lubricant (e.g., oil) level within an oil sump (not shown) of the internal cavity of the second compressor 14. The device 54 may communicate data to the control module 23 that the lubricant level within the second compressor 14 is above or below a predetermined level. The device 54 may give off an alarm (via status lights) if the lubricant level within the second compressor 14 is above or below a predetermined level. In some configurations, the device 54 may be movable between an open position in order to allow lubricant into or out of the second compressor 14 and a closed position in order to prevent lubricant into or out of the second compressor 14. The device 54 may be movable between the open and closed positions by the control module 23 or by the lubricant level within the oil sump being above or below the predetermined level.

A lubricant or oil equalization conduit 62 may extend between the first compressors 12 and may be in fluid communication with internal cavities (not shown) of the first compressors 12. The second oil-management valve device 56 is attached to the lubricant conduit 62 and is in fluid communication with the lubricant conduit 62. The device 56 monitors the lubricant (e.g., oil) levels within oil sumps of the internal cavities of the first compressors 12. The device 56 may communicate data to the control module 23 that the lubricant levels within the first compressors 12 are above or below a predetermined level. The device 56 may give off an alarm (via status lights) if the lubricant levels within the first compressors 12 are above or below a predetermined level. The device 56 may be movable between an open position in order to allow lubricant into or out of the first compressors 12 and a closed position in order to prevent lubricant into or out of the first compressors 12. The device 56 may be movable between the open and closed positions by the control module 23 or by the lubricant level within the oil sumps of the first compressors 12 being above or below the predetermined levels.

In some configurations, as shown in FIG. 2, each first compressor 12*a*, 12*b* may include oil-management valve devices 56*a*, 56*b*, respectively. That is, the oil-management valve device 56*a* may be attached to the first compressor 12*a* and may be in fluid communication with an oil sump (and an internal cavity) of the first compressor 12*a*. The device 56*a* may also be in fluid communication with the oil separator 52 via an oil passageway 60*a*. Similarly, the oil-management valve device 56*b* may be attached to the first compressor 12*b* and may be in fluid communication with an oil sump (and an internal cavity) of the first compressor 12*b*. The device 56*b* may also be in fluid communication with the oil separator 52 via an oil passageway 60*b*. In this way, the lubricant levels within each compressor 12*a*, 12*b* may be monitored individually and filled separately, for example.

Referencing back to FIG. 1, the first oil passageway 58 extends from a conduit 64 that is in fluid communication with an outlet 57 of the oil separator 52 to the device 54. A fourth valve 66 is disposed along the first oil passageway 58 and is movable between an open position in which lubricant in the oil separator 52 is allowed to flow to the second compressor 14 (via the device 54) and a closed position in which lubricant in the oil separator 52 is prevented from flowing to the second compressor 14 (via the device 54). The second oil passageway 60 extends from the conduit 64 to the device 56. A fifth valve 68 is disposed along the second oil passageway 60 and is movable between an open position in which lubricant in the oil separator 52 is allowed to flow to the device 56 and into the first compressors 12, and a closed position in which lubricant in the oil separator 52 is prevented to flow to the device 56 and into the first compressors 12.

In some configurations, a third oil passageway 70 may extend from the first oil passageway 58 at a location downstream of the fourth valve 66 to the second oil passageway 60 at a location downstream of the fifth valve 68. A sixth valve 72 is disposed along the third oil passageway 70 and is movable between open and closed positions. A fourth oil passageway 74 may extend from the discharge line 30 of the first compressors 12 to the suction line 38 of the second compressor 14. A seventh valve 76 is disposed along the fourth oil passageway 74 and is movable between open and closed positions to allow and restrict a portion of the compressed working fluid discharged from the first compressors 14 to flow to the suction line 38 of the second compressor 14.

Figure 3:
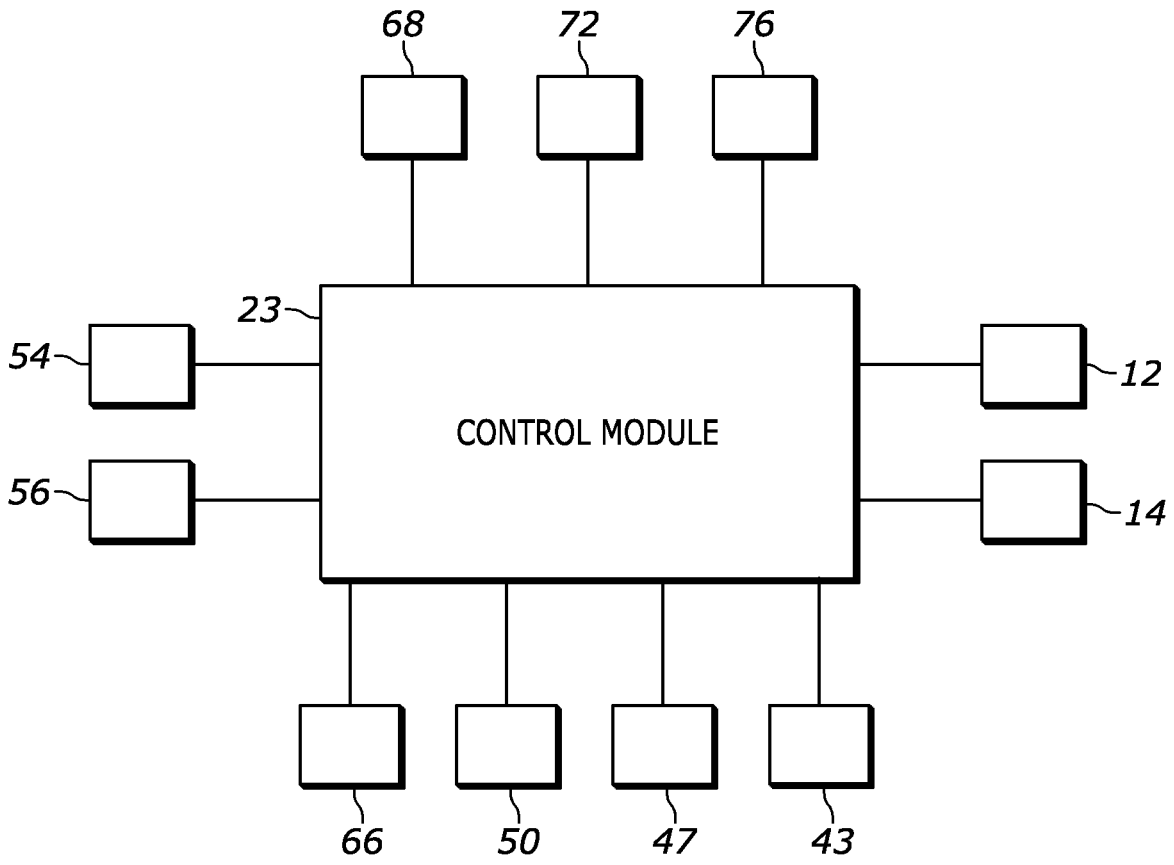
FIG. 3 is a block diagram illustrating communication between a control module and components of the climate-control system of FIG. 1.

As shown in FIG. 3, the control module 23 may be in communication with the first compressors 12, the second compressor 14, the valves 43, 47, 50, 66, 68, 72 76 and the devices 54, 56, for example. The control module 23 may control operation of the first compressors 12, the second compressor 14, the valves 43, 47, 50, 66, 68, 72 76 and the devices 54, 56 based at least partially on lubricant levels within the first and second compressors 12, 14. Based on the lubricant levels within the first and second compressors 12, 14, the control module can open and close the valves 43, 47, 50, 66, 68, 72 76 and the devices 54, 56, and can control operation of the first and second compressors 12, 14.

In a Micro Booster climate-control system, compressed working fluid from the second compressor 14 (e.g., a low-temperature compressor) flows into the first compressors 12 (e.g., a medium-temperature compressor). Due to the first and second compressors 12, 14 operating at different suction pressures, for example, the flow rate and the lubricant circulation rate of the second compressor 14 may be lower than that of the first compressors 12. This may cause the second compressor 14 to fill up with lubricant while operating, which decreases the efficiency of the system 10.

Figure 4:
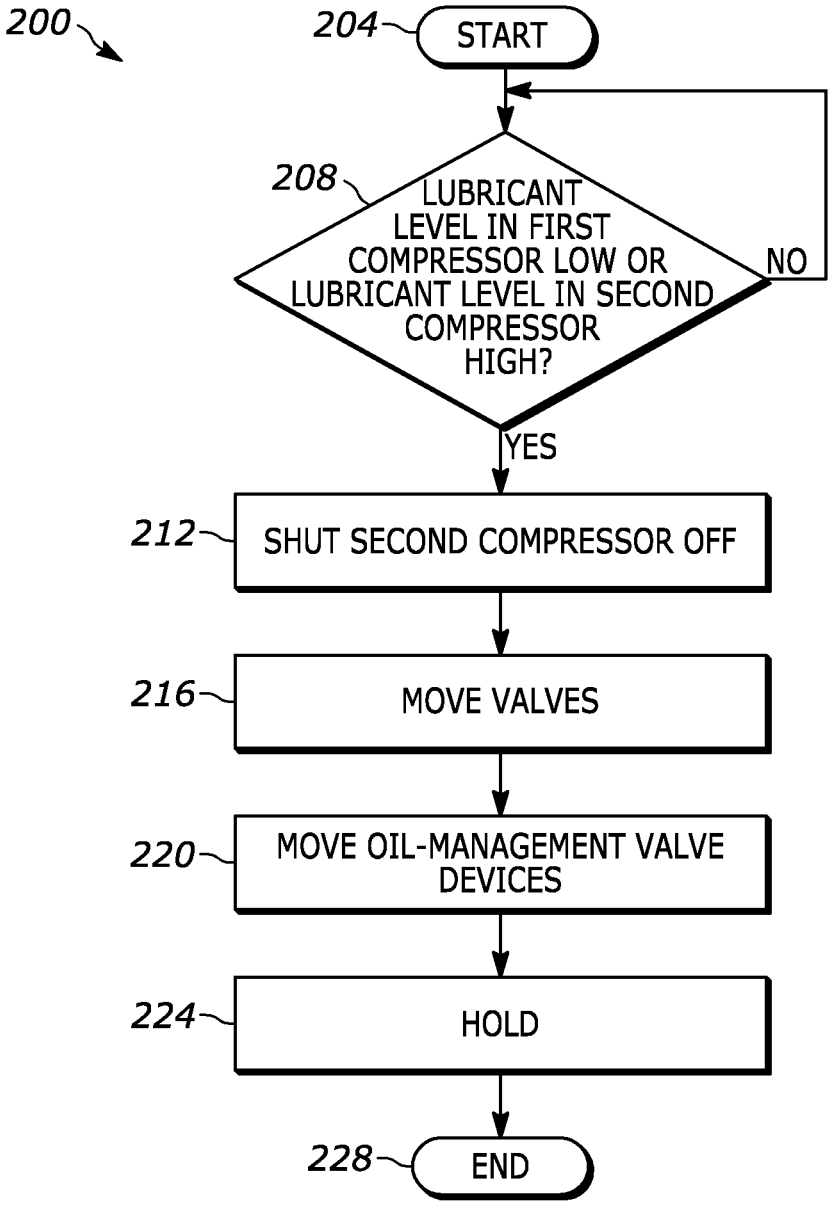
FIG. 4 is a flowchart depicting an algorithm for purging oil of one compressor to another compressor of the climate-control system of FIG. 1.

With reference to FIG. 4, a flowchart 200 showing an example implementation of a control algorithm for lubricant (e.g., oil) purge in a refrigeration system is shown. The control algorithm begins at 204. At 208, the control algorithm, using the control module 23 determines if lubricant in the first compressors 12 are below a predetermined level or if lubricant in the second compressor 14 is above a predetermined level. In some configurations, the lubricant purge may be on a schedule such as during defrost. If the lubricant in the first compressors 12 is below a predetermined level or if lubricant in the second compressor 14 is above a predetermined level, the control algorithm proceeds to 212; otherwise, the control algorithm remains at 208 until the lubricant in the first compressors 12 is below a predetermined level or lubricant in the second compressor 14 is above a predetermined level.

At 212, the control algorithm, using the control module 23, shuts the second compressor 14 to an OFF-mode. The first compressors 12 remain in an ON-mode when the second compressor 14 is shut to the OFF-mode. After shutting the second compressor 14 to the OFF-mode, the control algorithm then proceeds to 216.

At 216, the control algorithm, using the control module 23, moves the valves 43, 66, 68, 72, 76. That is, valves 43, 66 and 68 are each moved from the open position to the closed position and valves 72 and 76 are each moved from the closed position to the open position. This is done approximately 1 minute after the second compressor has been shut to the OFF-mode so that the lubricant within the second compressor 14 settles. It should be understood that the valves 43, 66, 68, 72, 76 may be moved simultaneously or in a sequence (e.g., moving valve 43 to the closed position, then moving valve 76 to the open position, then moving valve 72 to the open position, then moving valve 68 to the closed position and finally moving valve 66 to the closed position).

Moving the valve 76 to the open position allows a portion of the compressed working fluid discharged from the first compressors 12 to flow to the suction line 38 of the second compressor 14 via the fourth oil passageway 74. A check valve 80 disposed along the suction line 38 prevents the compressed working fluid from entering the third heat exchanger 20. After moving the valves 43, 66, 68, 72, 76, the control algorithm then proceeds to 220.

At 220, the control algorithm, using the control module 23, moves the devices 54, 56 to the open position. In this way, lubricant in the second compressor 14 is purged into the first compressors 12 via the third oil passageway 70. That is, the portion of the compressed working fluid discharged from the first compressors 12 and flowing into the second compressor 14 (via the inlet 34) will force the lubricant out of the second compressor 14 and into the first compressors 12 via the third oil passageway 70 and the lubricant conduit 62. After moving the devices 54, 56, the control algorithm then proceeds to 224.

At 224, the control algorithm, using the control module 23, holds the valves 43, 66, 68 72, 76 and the devices 54, 56 in the respective positions for a predetermined time period (e.g., 5 second, 10 seconds or any other suitable time period) before returning to their normal state (i.e., the state that the valves 43, 66, 68, 72, 76 and the devices 54, 56 were originally positioned). The control module 23 then proceeds to 228 and ends.

Figure 5:
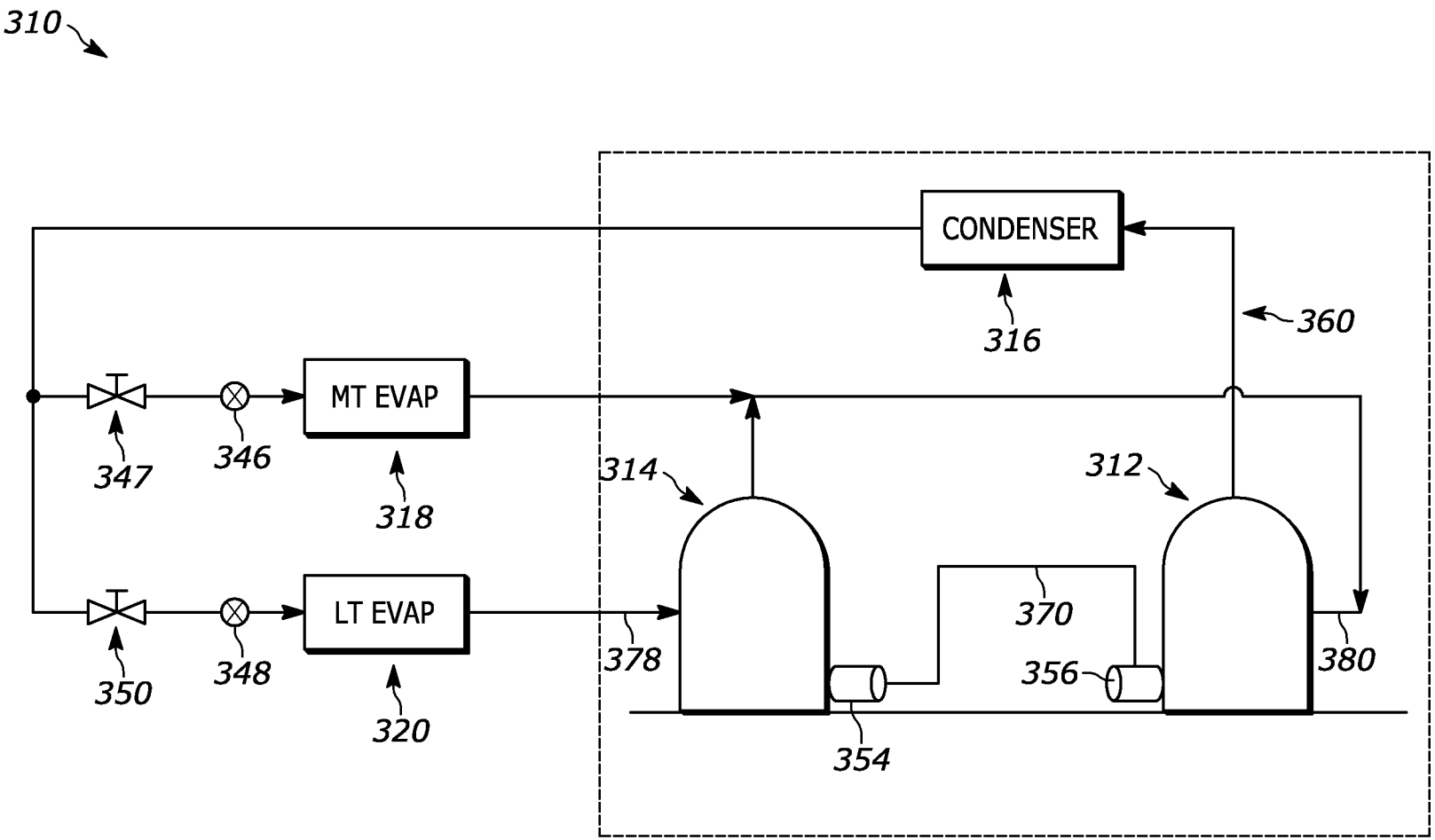
FIG. 5 is yet another schematic representation of a climate-control system.
Figure 6:
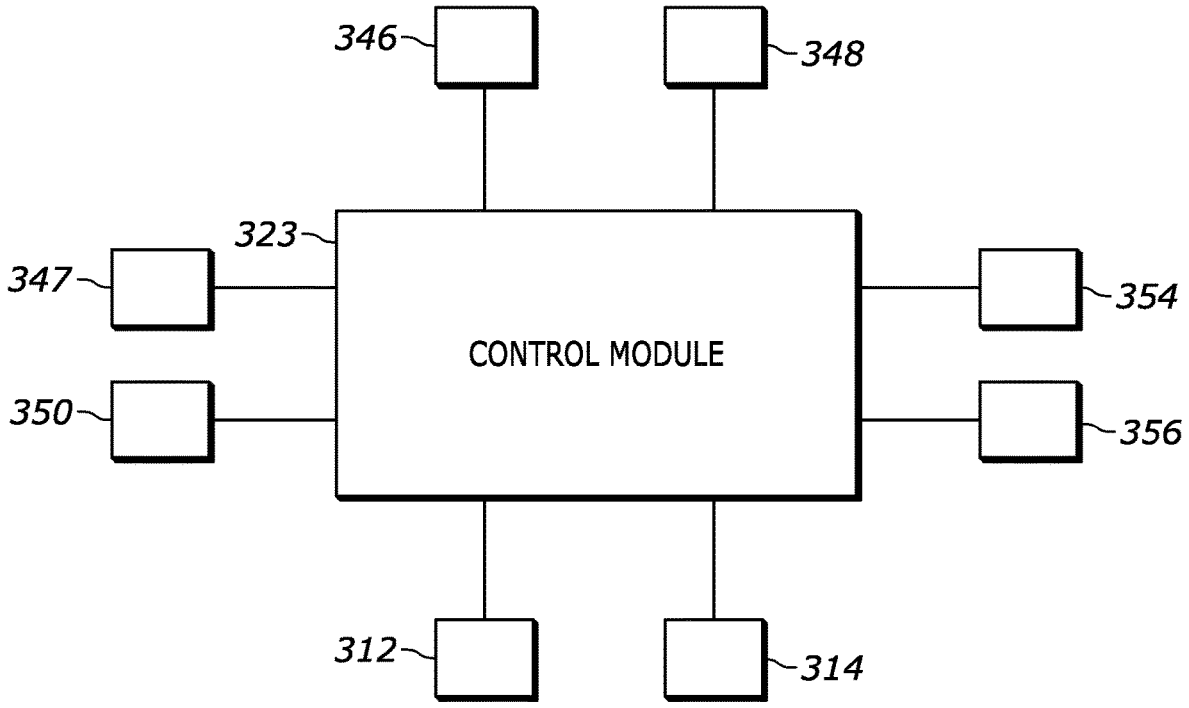
FIG. 6 is a block diagram illustrating communication between a control module and components of the climate-control system of FIG. 5.

With reference to FIGS. 5 and 6, another climate control system 310 is provided that may be generally similar to the climate-control system 10 described above, apart from any exceptions noted below. The climate-control system 310 may include a fluid-circuit having one or more first compressors 312, one or more second compressors 314, a first heat exchanger 316 (an outdoor heat exchanger such as a condenser or gas cooler, for example), a second heat exchanger 318, (an indoor heat exchanger such as a medium-temperature evaporator, for example) a third heat exchanger 320 (an indoor heat exchanger such as a low-temperature evaporator, for example) and a control module 323. The structure and function of the first compressor 312, the second compressor 314, the first heat exchanger 316, the second heat exchanger 318, the third heat exchanger 320 and the control module 323 may be similar or identical to that of the first compressors 12, the second compressor 14, the first heat exchanger 16, the second heat exchanger 18, the third heat exchanger 20 and the control module 23, respectively, described above, and therefore, will not be described again in detail.

The structure and function of a first expansion device 346, a second expansion device 348, a valve 347 and a valve 350 may be similar or identical to that of the first expansion device 46, the second expansion device 48, the valve 47 and the valve 50, respectively, described above, and therefore, will not be described again in detail.

A first oil-management valve device 354 is attached to the second compressor 314 and is in fluid communication with an internal cavity (not shown) of the second compressor 314. The device 354 monitors the lubricant (e.g., oil) level within an oil sump (not shown) of the internal cavity of the second compressor 314. The device 354 may communicate data to the control module 323 that the lubricant level within the second compressor 314 is above or below a predetermined level. The device 354 may give off an alarm (via status lights) if the lubricant level within the second compressor 314 is above or below a predetermined level. The device 354 may be movable between an open position in order to allow lubricant into or out of the second compressor 314 and a closed position in order to prevent lubricant into or out of the second compressor 314. The device 354 may be movable between the open and closed positions by the control module 323 or by the lubricant level within the oil sump being above or below the predetermined level.

A second oil-management valve device 356 is attached to first compressor 312 and is in fluid communication with internal cavities (not shown) of the first compressor 312. The device 356 monitors the lubricant (e.g., oil) level within an oil sump (not shown) of the internal cavity of the first compressor 312. The device 356 may communicate data to the control module 323 that the lubricant level within the first compressor 312 is above or below a predetermined level. The device 356 may give off an alarm (via status lights) if the lubricant level within the first compressor 12 is above or below a predetermined level. In some configurations, the device 356 may be movable between an open position in order to allow lubricant into or out of the first compressor 312 and a closed position in order to prevent lubricant into or out of the first compressor 312. The device 356 may be movable between the open and closed positions by the control module 323 or by the lubricant level within the oil sumps being above or below the predetermined levels. In some configurations, an oil separator (not shown) may be disposed along the discharge line 360 such that compressed working fluid discharged from the first compressor 312 passes through the oil separator and lubricant (e.g., oil) therein is entrapped in the oil separator. The oil separator may also distribute lubricant (e.g., oil) therein to the first compressor 312 (via the device 356 and an oil passageway (not shown)) and to the second compressor 314 (via the device 354 and an oil passageway (not shown)).

An oil conduit 370 may be in fluid communication with the first and second devices 354, 356 and may allow lubricant within the second compressor 314 to flow to the first compressor 312 and vice versa.

Figure 7:
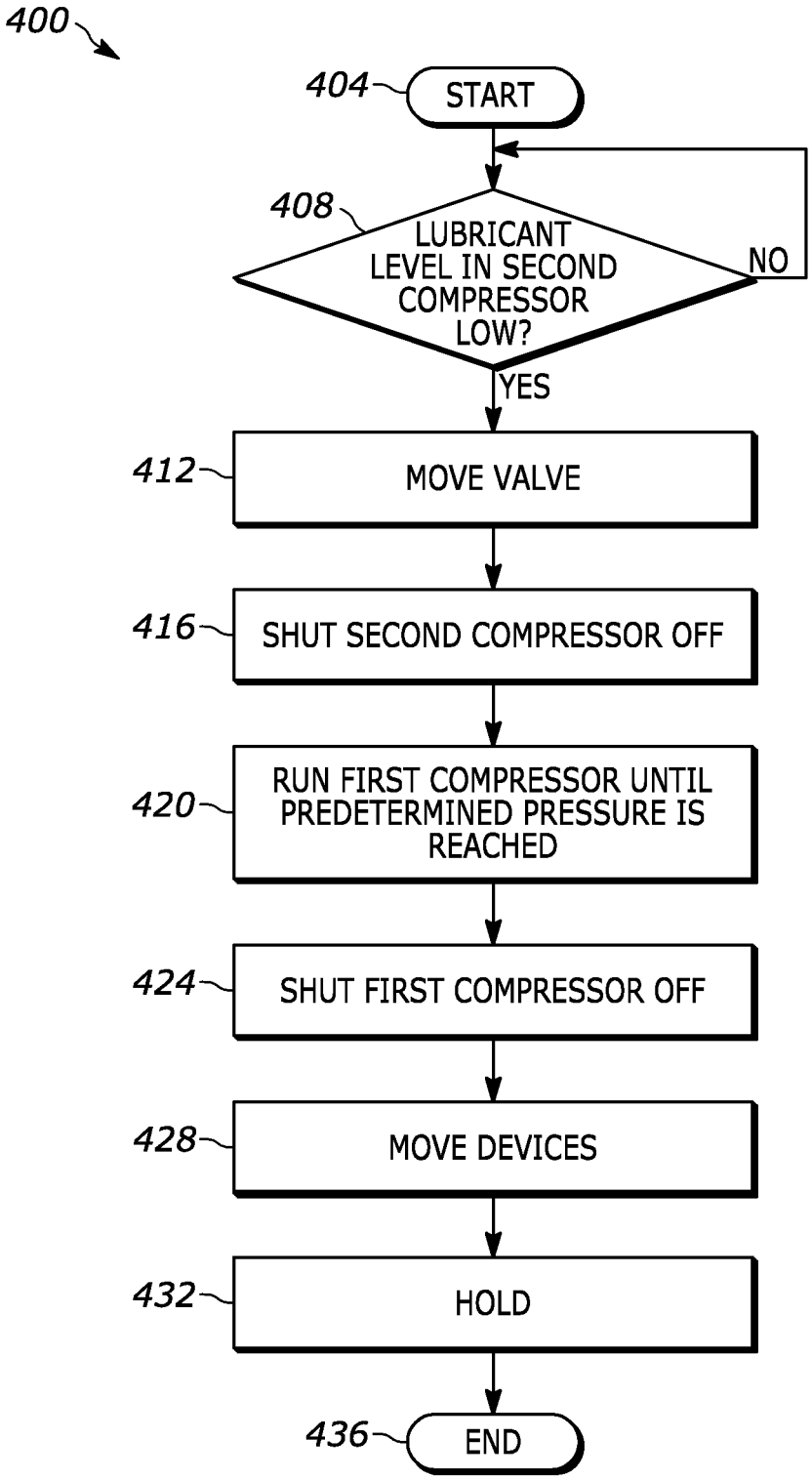
FIG. 7 is a flowchart depicting an algorithm for purging oil of one compressor to another compressor of the climate-control system of FIG. 5.

With reference to FIG. 7, a flowchart 400 showing an example implementation of a control algorithm for oil purge in a refrigeration system is shown. The control algorithm begins at 404. At 408, the control algorithm, using the control module 323 determines if lubricant in the first compressor 312 is below a predetermined level. In some configurations, the lubricant purge may be on a schedule such as during defrost. If the lubricant in the first compressor 312 is below a predetermined level, the control algorithm proceeds to 412; otherwise, the control algorithm remains at 408 until the lubricant in the first compressor 312 is below a predetermined level.

At 412, the control algorithm, using the control module 323, moves the valve 347 from an open position to a closed position. In this way, working fluid exiting the first heat exchanger 316 is prevented from flowing to the second heat exchanger 318. After moving the valve 347 to the closed positon, the control algorithm then proceeds to 416.

At 416, the control algorithm, using the control module 323, shuts the second compressor 314 to an OFF-mode. After shutting the second compressor 314 to the OFF-mode, the control algorithm then proceeds to 420. At 420, the control algorithm, using the control module 323, runs the first compressor 312 for a predetermined time period (e.g., 30 seconds, 1 minute or any other suitable time) or until the first compressor 312 reaches a predetermined pressure setting. In this way, the first compressor 312 pumps down (i.e., draws the working fluid out of the second heat exchanger 318). After running the first compressor 312 for a predetermined time period or until the first compressor 312 reaches a predetermined pressure setting, the control algorithm then proceeds to 424.

At 424, the control algorithm, using the control module 323, shuts the first compressor 312 to an OFF-mode. The pressure in a suction line 378 of the second compressor 314 is greater than a pressure in a suction line 380 of the first compressor 312. After shutting the first compressor 312 to the OFF-mode, the control algorithm then proceeds to 428.

At 428, the control algorithm, using the control module 323, moves the devices 354, 356 to the open position. In this way, lubricant in the second compressor 314 is purged into the first compressor 312 via the oil conduit 370. That is, pressure of working fluid in the second compressor 314 is greater than the pressure of working fluid in the first compressor 312, which forces the lubricant out of the second compressor 314 and into the first compressor 312 via the oil conduit 370. After moving the devices 354, 356 to the open position, the control algorithm proceeds to 432.

At 432, the control algorithm, using the control module 323, holds the valve 347, the devices 354, 356 and the first and second compressors 312, 314 in the respective positions for a predetermined time period (e.g., 5 second, 10 seconds or any other suitable time period) before returning to their normal state (i.e., the state that the valve 347, the devices 354, 356 and the first and second compressors 312, 314 were originally situated). The control module 323 then proceeds to 436 and ends.

Figure 8:
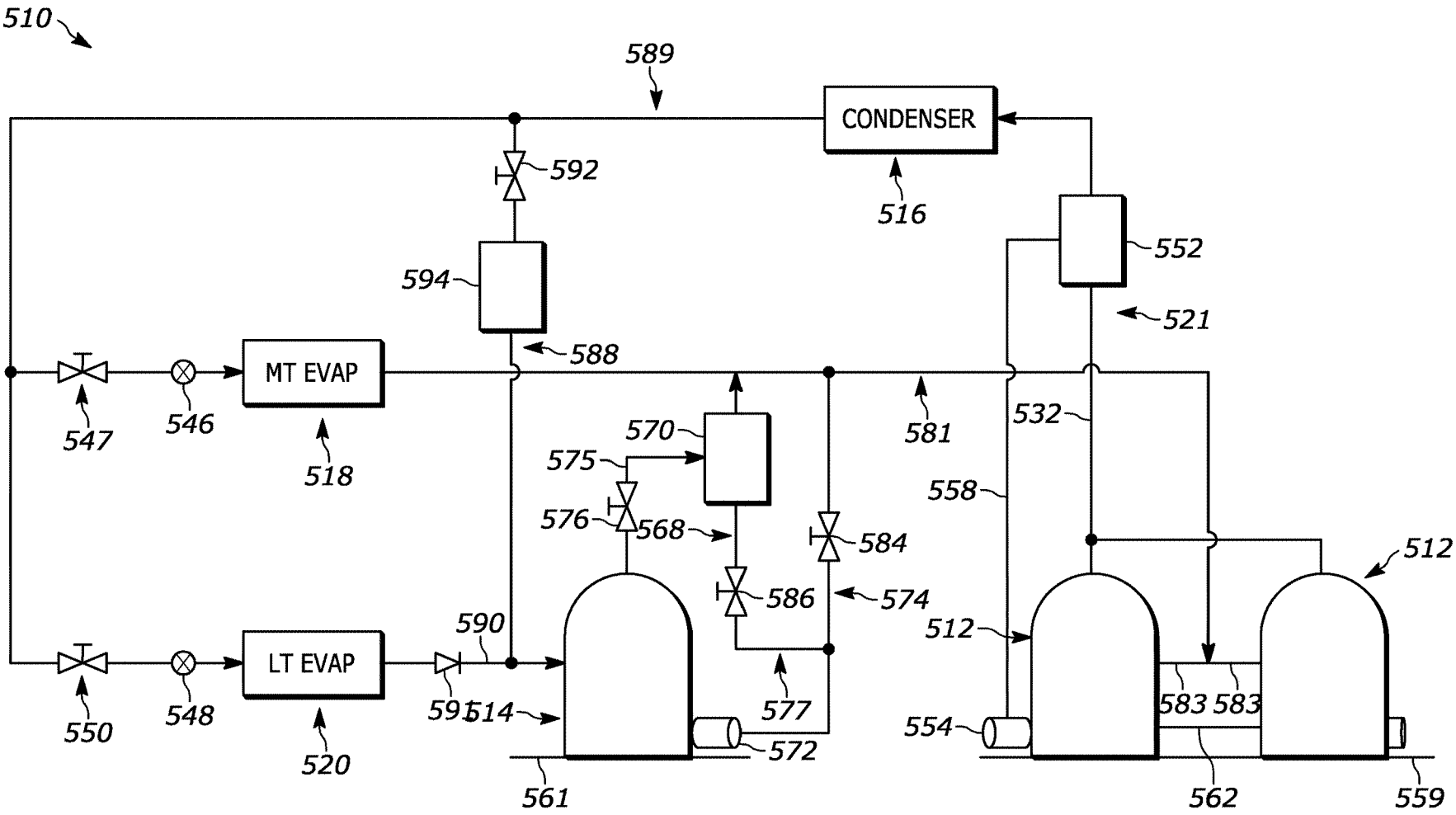
FIG. 8 is yet another schematic representation of a climate-control system.
Figure 9:
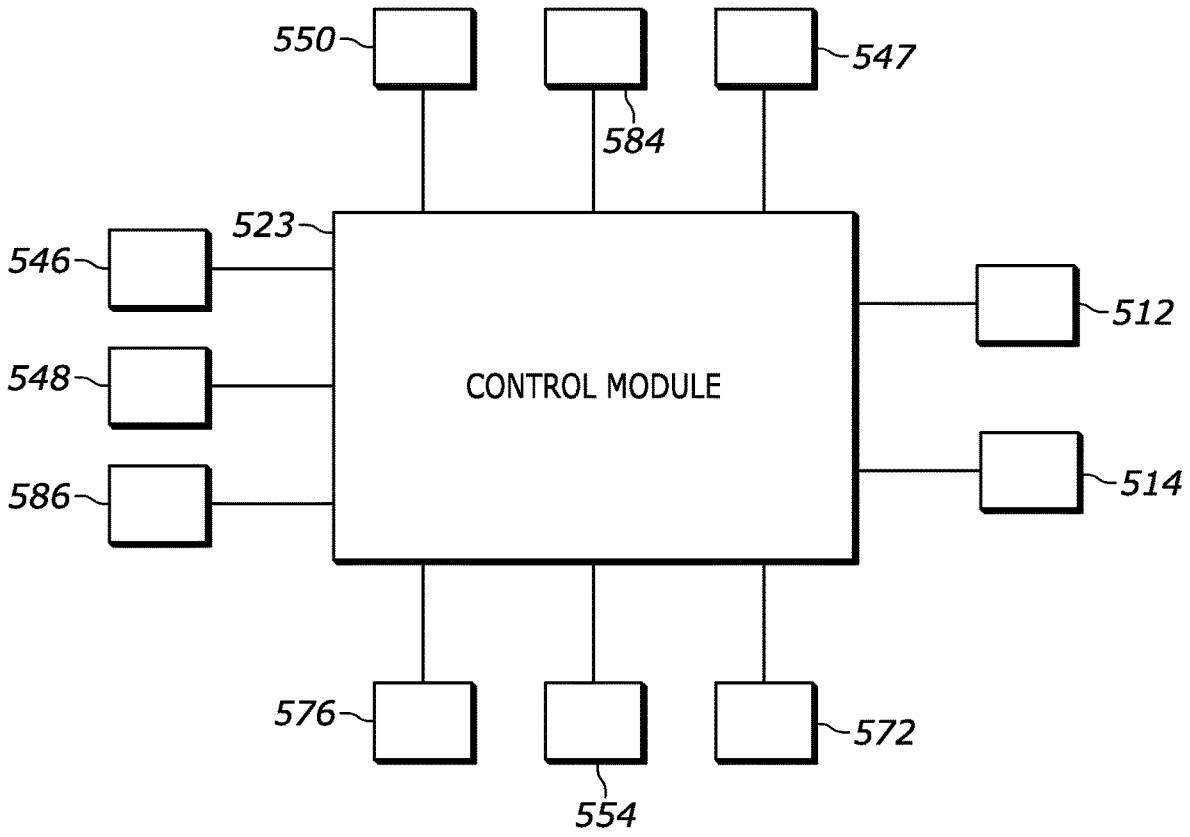
FIG. 9 is a block diagram illustrating communication between a control module and components of the climate-control system of FIG. 8.

With reference to FIGS. 8 and 9, another climate control system 510 is provided that may be generally similar to the climate-control systems 10, 310 described above, apart from any exceptions noted below. The climate-control system 510 may include a fluid-circuit having one or more first compressors 512, one or more second compressors 514, a first heat exchanger 516 (an outdoor heat exchanger such as a condenser or gas cooler, for example), a second heat exchanger 518, (an indoor heat exchanger such as a medium-temperature evaporator, for example) a third heat exchanger 520 (an indoor heat exchanger such as a low-temperature evaporator, for example) and a control module 523.

The structure and function of the first compressors 512 may be similar or identical to that of the first compressors 12, 312 described above, and therefore, will not be described again in detail. The structure and function of the second compressor 514 may be similar or identical to that of the second compressors 14, 314 described above, and therefore, will not be described again in detail. The structure and function of the first heat exchanger 516 may be similar or identical to that of the heat exchangers 16, 316 described above, and therefore, will not be described again in detail. The structure and function of the second heat exchanger 518 may be similar or identical to that of the heat exchangers 18, 318 described above, and therefore, will not be described again in detail. The structure and function of the third heat exchanger 520 may be similar or identical to that of the heat exchangers 20, 320 described above, and therefore, will not be described again in detail. The control module 523 may be similar or identical to that of the control modules 23, 323 described above, and therefore, will not be described again in detail.

The structure and function of a first expansion device 546 may be similar or identical to that of the expansion devices 46, 346 described above, and therefore, will not be described again in detail. The structure and function of a second expansion device 548 may be similar or identical to that of the expansion devices 48, 348 described above, and therefore will not be described again in detail. The structure and function of a first valve 547 may be similar or identical to that of the valves 47, 347 described above, and therefore, will not be described again in detail. The structure and function of a second valve 550 may be similar or identical to that of the valves 50, 350 described above, and therefore, will not be described again in detail.

The first compressors 512 may be on a base plate 559 and the second compressor 514 may be on a base plate 561 that is at a remote location relative to the first compressors 512. A first oil apparatus 521 may include a first oil separator 552, a first oil-management valve device 554 and a first oil passageway 558. The first oil separator 552 is disposed along a discharge line 532 of the first compressors 512 such that compressed working fluid discharged from the first compressors 512 passes through the first oil separator 552 and the lubricant (e.g., oil) therein is entrapped in the first oil separator 552.

A lubricant or oil equalization conduit 562 may extend between the first compressors 512 and may be in fluid communication with internal cavities (not shown) of the first compressors 512. The first oil-management valve device 554 is attached to the lubricant conduit 562 and is in fluid communication with the lubricant conduit 562. The device 554 monitors the lubricant (e.g., oil) level within oil sumps (not shown) of the internal cavities of the first compressors 512. The device 554 may communicate data to the control module 523 that the lubricant levels within the first compressors 512 are above or below a predetermined level. The device 554 may give off an alarm (via status lights) if the lubricant levels within the first compressors 512 are above or below a predetermined level. The device 554 may be movable between an open position in order to allow lubricant into or out of the first compressors 512 and a closed position in order to prevent lubricant into or out of the first compressors 512. The device 554 may be movable between the open and closed positions by the control module 523 or by the lubricant level within the oil sumps being above or below the predetermined levels.

A second oil apparatus 568 may include a second oil separator 570, a second oil-management valve device 572 and second and third oil passageways 574, 577. The second oil separator 570 is disposed along a discharge line 575 of the second compressor 514 such that compressed working fluid discharged from the second compressor 514 passes through the second oil separator 570 and the lubricant (e.g., oil) therein is entrapped in the second oil separator 570. The second oil separator 570 may be a bi-directional oil separator, for example. In this way, lubricant in the second oil separator 570 may be allowed to flow to the second compressor 514, and lubricant in the oil sump (not shown) of the second compressor 514 may be allowed to flow to the second oil separator 570. A valve 576 is disposed along the discharge line 575 of the second compressor 514 and is movable between open and closed positions.

The second oil-management valve device 572 is attached to the second compressor 514 and is in fluid communication with an internal cavity (not shown) of the second compressor 514. The device 572 monitors the lubricant (e.g., oil) level within an oil sump of the internal cavity of the second compressor 514. The device 572 may communicate data to the control module 523 that the lubricant level within the second compressor 514 is above or below a predetermined level. The device 572 may give off an alarm (via status lights) if the lubricant level within the second compressor 514 is above or below a predetermined level. The device 572 may be movable between an open position in order to allow lubricant into or out of the second compressor 514 and a closed position in order to prevent lubricant into or out of the second compressor 514. The device 572 may be movable between the open and closed positions by the control module 523 or by the lubricant level within the oil sump being above or below the predetermined level.

A first fluid passageway 581 extends from the second heat exchanger 518 to suction lines 583 of the first compressors 512. The second oil passageway 574 extends from the first fluid passageway 581 at a location between the first compressors 512 and the second heat exchanger 518 to the device 572. A valve 584 is disposed along the second oil passageway 574 and is movable between open and closed positions. The third oil passageway 577 extends from an outlet of the second oil separator 570 to a location of the second oil passageway 574 between the device 572 and the valve 584. A valve 586 is disposed along the third oil passageway 577 and is movable between open and closed positions.

A second fluid passageway 588 extends from a third fluid passageway 589 at a location downstream of the first heat exchanger 516 to a suction line 590 of the second compressor 514. A valve 592 is disposed along the second fluid passageway 588 and is movable between open and closed positions. An accumulator 594 is also disposed along the second fluid passageway at a location downstream of the valve 592 and may remove liquid from working fluid passing therethrough such that liquid does not enter into the second compressor 514.

Figure 10:
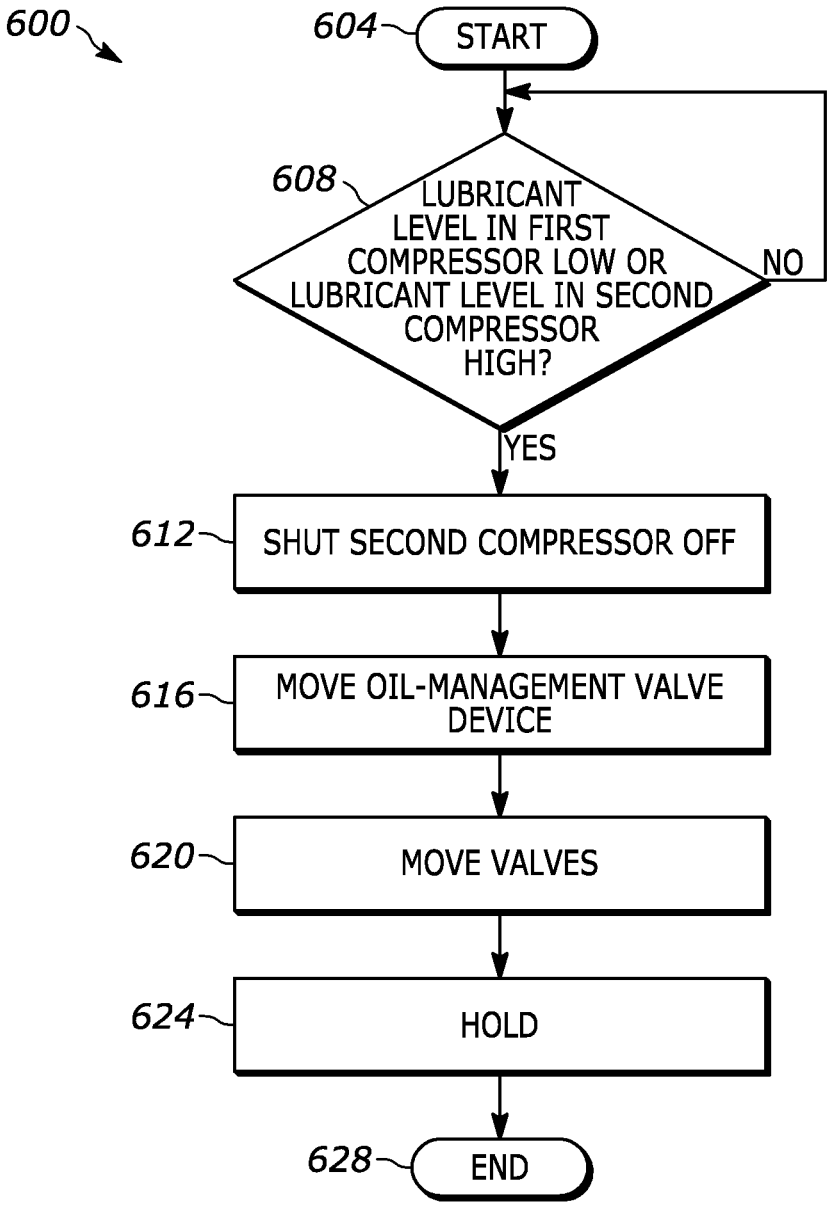
FIG. 10 is a flowchart depicting an algorithm for purging oil of one compressor to another compressor of the climate-control system of FIG. 8.

With reference to FIG. 10, a flowchart 600 showing an example implementation of a control algorithm for oil purge in a refrigeration system is shown. The control algorithm begins at 604. At 608, the control algorithm, using the control module 523 determines if lubricant in the first compressors 512 is below a predetermined level or if the lubricant in the second compressor 514 is above a predetermined level. In some configurations, the lubricant purge may be on a schedule such as during defrost. If the lubricant in the first compressors 512 is below a predetermined level or if the lubricant in the second compressor 514 is above a predetermined level, the control algorithm proceeds to 612; otherwise, the control algorithm remains at 608 until the lubricant in the first compressors 512 is below a predetermined level or the second compressor 514 is above a predetermined level.

At 612, the control algorithm, using the control module 523, shuts the second compressor 514 to an OFF-mode.

After shutting the second compressor 514 to the OFF-mode, the control algorithm then proceeds to 616.

At 616, the control algorithm, using the control module 523, moves the device 572 to an open position. In this way, lubricant may exit the second compressor 514 through the device 572. After moving the device 572 to the open positon, the control algorithm then proceeds to 620.

At 620, the control algorithm, using the control module 523, moves the valves 576, 584, 586, 592. That is, valves 576, 586 are each moved from the open position to the closed position and valves 584, 592 are each moved from the closed position to the open position. It should be understood that the valves 576, 584, 586, 592 may be moved simultaneously or in a sequence (e.g., moving the valve 592 to the open position, then moving the valve 576 to the closed position, then moving the valve 586 to the closed position and finally moving the valve 584 to the open position).

Moving the valve 592 to the open position allows a portion of the working fluid exiting the first heat exchanger 516 to flow into the second compressor 514 (via the second fluid passageway 588 and the suction line 590 of the second compressor 14). A check valve 591 disposed along the suction line 590 prevents the working fluid from entering the third heat exchanger 520. After moving the valves 576, 584, 586, 592, the control algorithm then proceeds to 624.

At 624, the control algorithm, using the control module 523, holds the valves 576, 584, 586, 592 and the device 572 in the respective positions for a predetermined time period (e.g., 5 second, 10 seconds, or any other suitable time period). The valve 592 may then be closed before returning the other valves to their normal state (i.e., the state that the valves 576, 584, 586 and the device 572 were originally positioned). The control module 523 then proceeds to 628 and ends.

Figure 11:
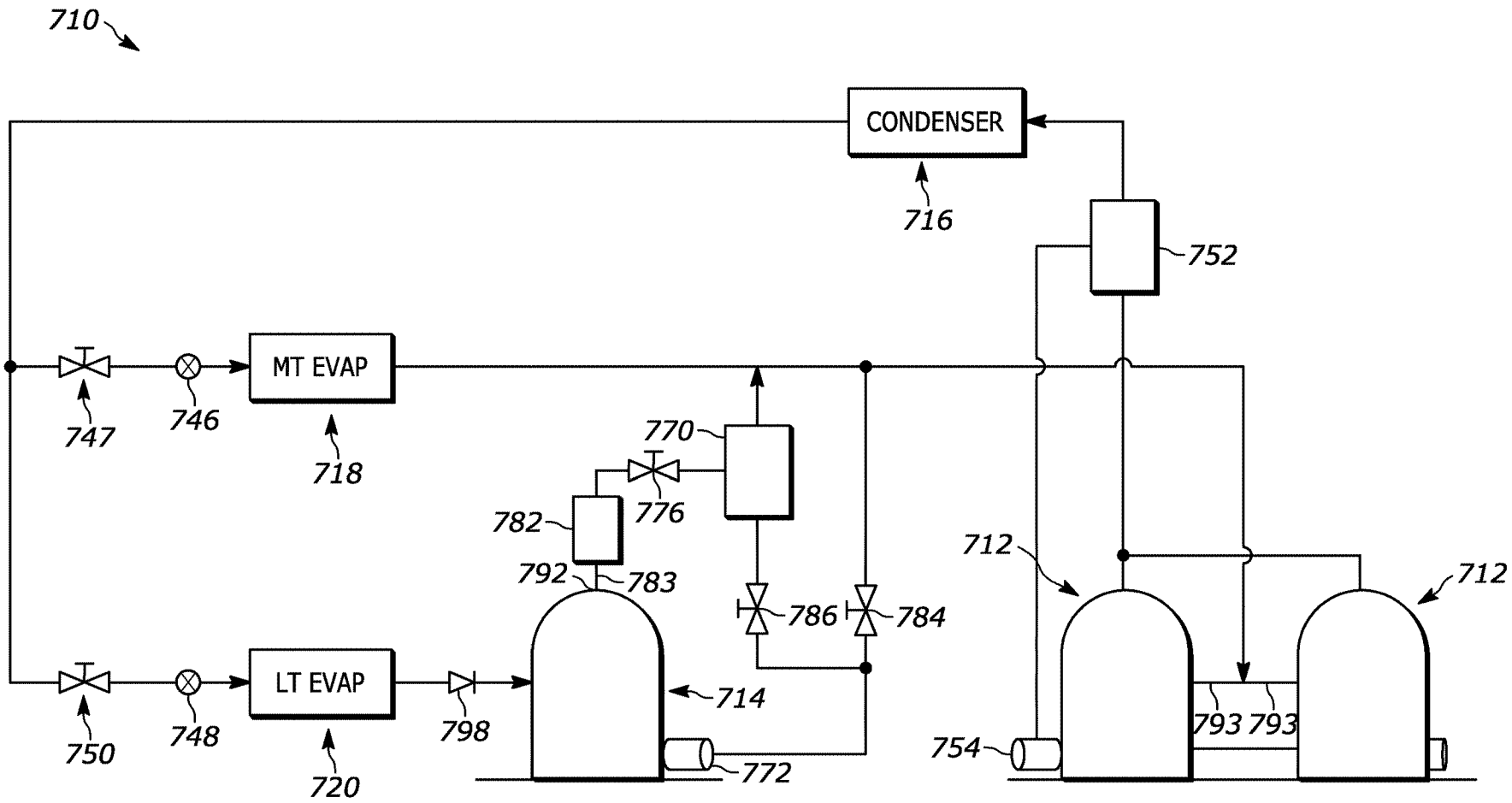
FIG. 11 is yet another schematic representation of a climate-control system.
Figure 12:
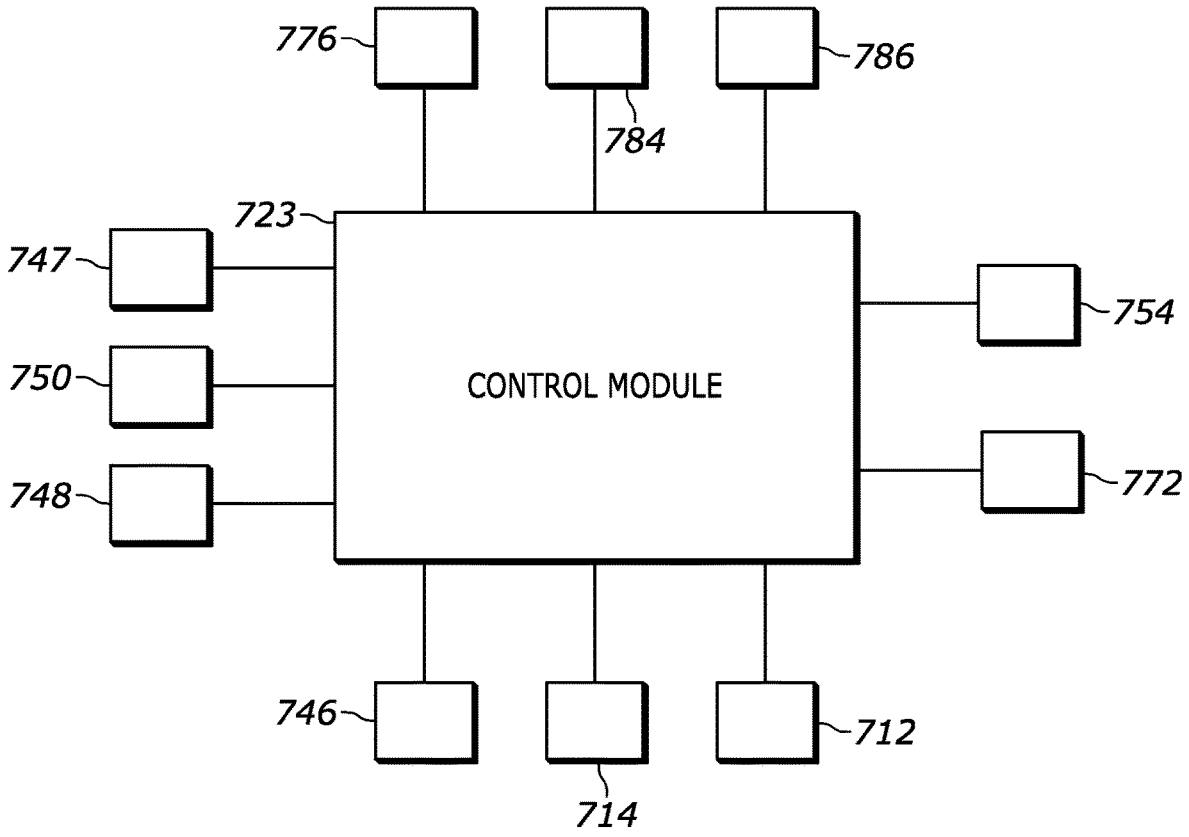
FIG. 12 is a block diagram illustrating communication between a control module and components of the climate-control system of FIG. 11.

With reference to FIGS. 11 and 12, another climate control system 710 is provided that may be generally similar to the climate-control systems 10, 310, 510 described above, apart from any exceptions noted below. The climate-control system 710 may include a fluid-circuit having one or more first compressors 712, one or more second compressors 714, a first heat exchanger 716 (an outdoor heat exchanger such as a condenser or gas cooler, for example), a second heat exchanger 718, (an indoor heat exchanger such as a medium-temperature evaporator, for example) a third heat exchanger 720 (an indoor heat exchanger such as a low-temperature evaporator, for example) and a control module 723.

The structure and function of the first compressors 712 may be similar or identical to that of the first compressors 12, 312, 512 described above, and therefore, will not be described again in detail. The structure and function of the second compressor 714 may be similar or identical to that of the second compressors 14, 314, 514 described above, and therefore, will not be described again in detail. The structure and function of the first heat exchanger 716 may be similar or identical to that of the heat exchangers 16, 316, 516 described above, and therefore, will not be described again in detail. The structure and function of the second heat exchanger 718 may be similar or identical to that of the heat exchangers 18, 318, 518 described above, and therefore, will not be described again in detail. The structure and function of the third heat exchanger 720 may be similar or identical to that of the heat exchangers 20, 320, 520 described above, and therefore, will not be described again in detail. The control module 723 may be similar or identical to that of the control modules 23, 323, 523 described above, and therefore, will not be described again in detail.

The structure and function of a first expansion device 746 may be similar or identical to that of the expansion devices 46, 346, 546 described above, and therefore, will not be described again in detail. The structure and function of a second expansion device 748 may be similar or identical to that of the expansion devices 48, 348, 548 described above, and therefore will not be described again in detail. The structure and function of a first valve 747 may be similar or identical to that of the valves 47, 347, 547 described above, and therefore, will not be described again in detail. The structure and function of a second valve 750 may be similar or identical to that of the valves 50, 350, 550 described above, and therefore, will not be described again in detail.

The structure and function of first and second oil separators 752, 770 may be similar or identical to that of the oil separators 552, 570, respectively, described above, and therefore, will not be described again in detail. The structure and function of first and second oil-management valve devices 754, 772 may be similar or identical to that of devices 554, 572, respectively, described above, and therefore, will not be described again in detail. The structure and function of first, second and third valves 776, 784, 786 may be similar or identical to that of the valves 576, 584, 586, respectively, described above, and therefore, will not be described again in detail.

Figure 13:
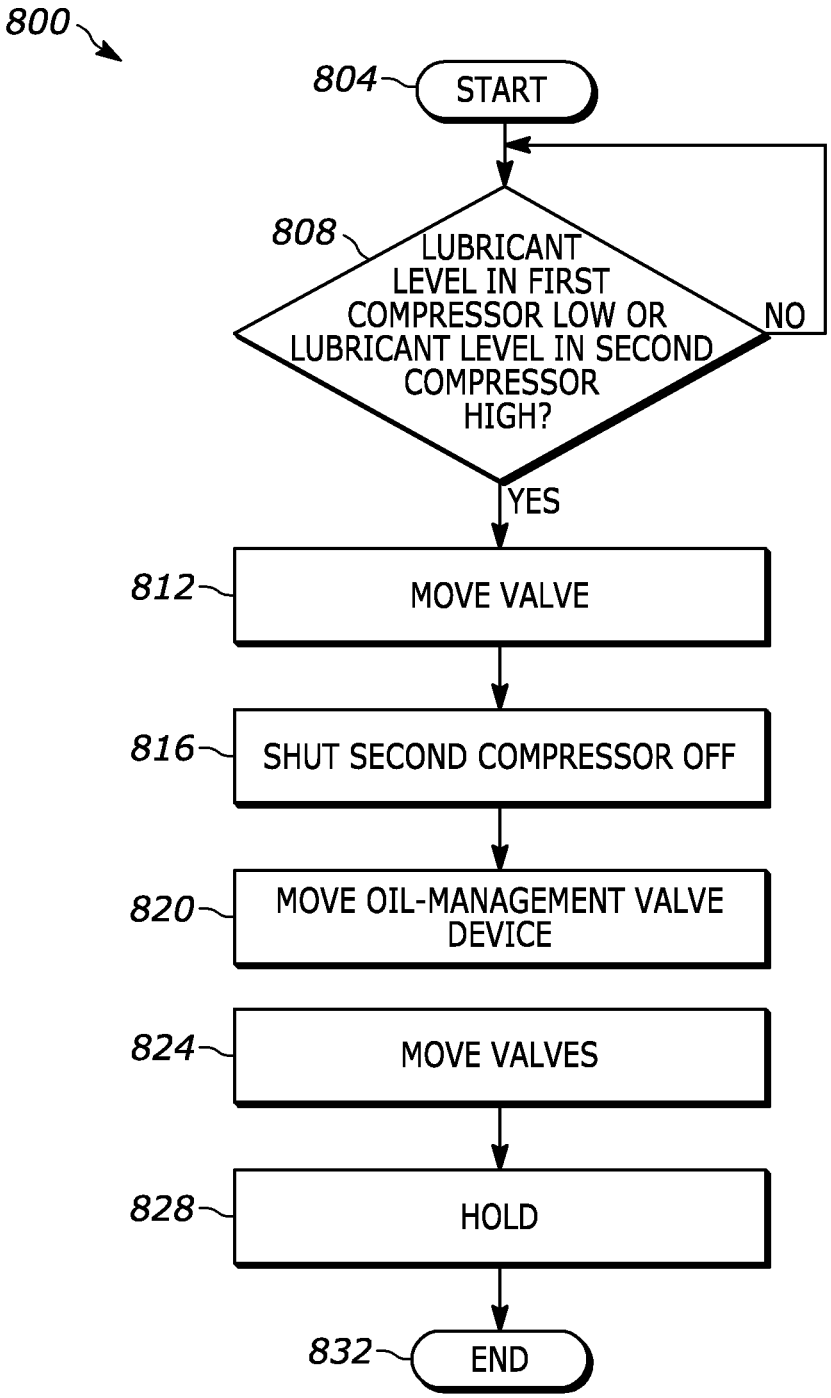
FIG. 13 is a flowchart depicting an algorithm for purging oil of one compressor to another compressor of the climate-control system of FIG. 11.

With reference to FIG. 13, a flowchart 800 showing an example implementation of a control algorithm for oil purge in a refrigeration system is shown. The control algorithm begins at 804. At 808, the control algorithm, using the control module 723 determines if lubricant in the first compressors 712 are below a predetermined level or if the lubricant in the second compressor 714 is above a predetermined level. In some configurations, the lubricant purge may be on a schedule such as during defrost. If the lubricant in the first compressors 712 is below a predetermined level or if the lubricant in the second compressor 714 is above a predetermined level, the control algorithm proceeds to 812; otherwise, the control algorithm remains at 808 until the lubricant in the first compressors 712 is below a predetermined level or lubricant in the second compressor 714 is above a predetermined level.

At 812, the control algorithm, using the control module 723, moves the valve 776 from an open position to a closed position. In this way, compressed working fluid discharged from the second compressor 714 fills a reservoir 782 disposed along a discharge line 783 of the second compressor 714 at a location upstream of the valve 776. After moving the valve 776 to the closed position, the control algorithm proceeds to 816.

At 816, the control algorithm, using the control module 723, shuts the second compressor 714 to an OFF-mode. After shutting the second compressor 714 to the OFF-mode, the control algorithm then proceeds to 820.

At 820, the control algorithm, using the control module 723, moves the device 772 to an open position. In this way, lubricant may exit the second compressor 714 through the device 772. After moving the device 772 to the open positon, the control algorithm then proceeds to 824.

At 824, the control algorithm, using the control module 723, moves the valves 784, 786. That is, the valve 784 is moved from a closed position to an open position and the valve 786 is moved from an open position to a closed position. It should be understood that the valves 784, 786 may be moved simultaneously or in a sequence (e.g., moving the valve 784 to the open position and then moving the valve 786 to the closed position).

The compressed working fluid contained in the reservoir 782 bleeds or flows back to the second compressor 714 (via an outlet 792 of the second compressor 714). In this way, the pressure in the internal cavity of the second compressor forces lubricant out of the second compressor 714 (via the device 772) and into the first compressors 712 (via inlets 793). A check valve 798 is disposed downstream of the third heat exchanger 720 such that working fluid does not enter into the third heat exchanger 720 from the second compressor 714. It should also be understood that the second compressor 714 does not include a check valve at a discharge fitting (not shown), which allows the high-pressure working fluid in the reservoir 782 to bleed or flow back into the second compressor 714, thereby forcing lubricant out of the second compressor 714 and into the first compressors 712.

In some configurations, the reservoir 782 may be removed and at least a portion of the discharge line 783 upstream of the valve 776 may include an increase diameter such that a sufficient amount of compressed working fluid may fill the discharge line 783 and bleed or flow back to the second compressor 714 (via the outlet 792). In this way, lubricant in the oil sump (not shown) of the second compressor 714 is forced out of the second compressor 714 (via the device 772) and into the first compressors 712 (via the inlets 793). After moving the valves 784, 786, the control algorithm then proceeds to 828.

At 828, the control algorithm, using the control module 723, holds the valves 776, 784, 786 and the device 772 in the respective positions for a predetermined time period (e.g., 5 second, 10 seconds or any other suitable time period) before returning to their normal state (i.e., the state that the valves 776, 784, 786 and the device 772 were originally positioned). The control module 723 then proceeds to 832 and ends.

Figure 14:
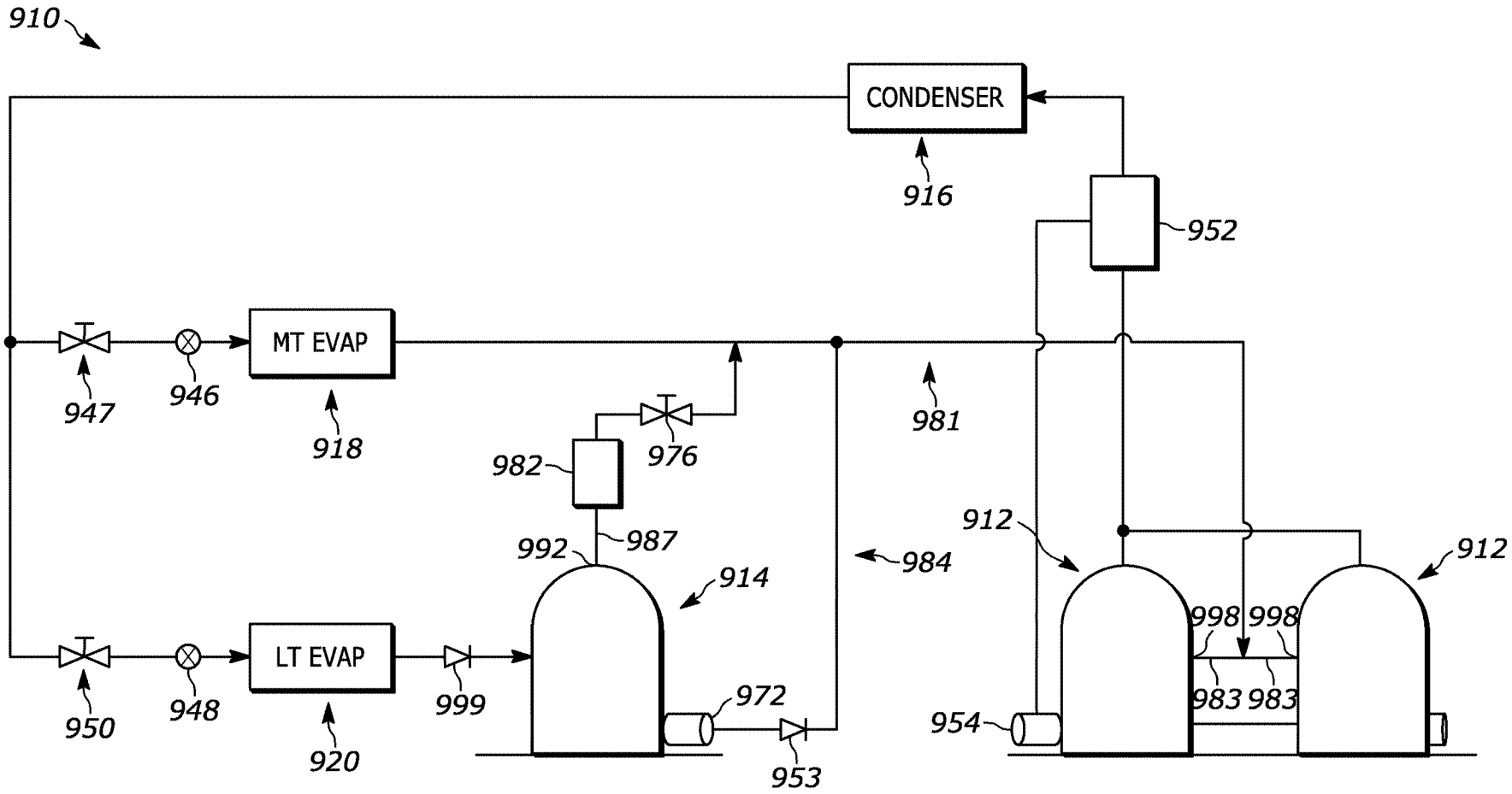
FIG. 14 is yet another schematic representation of a climate-control system.
Figure 15:
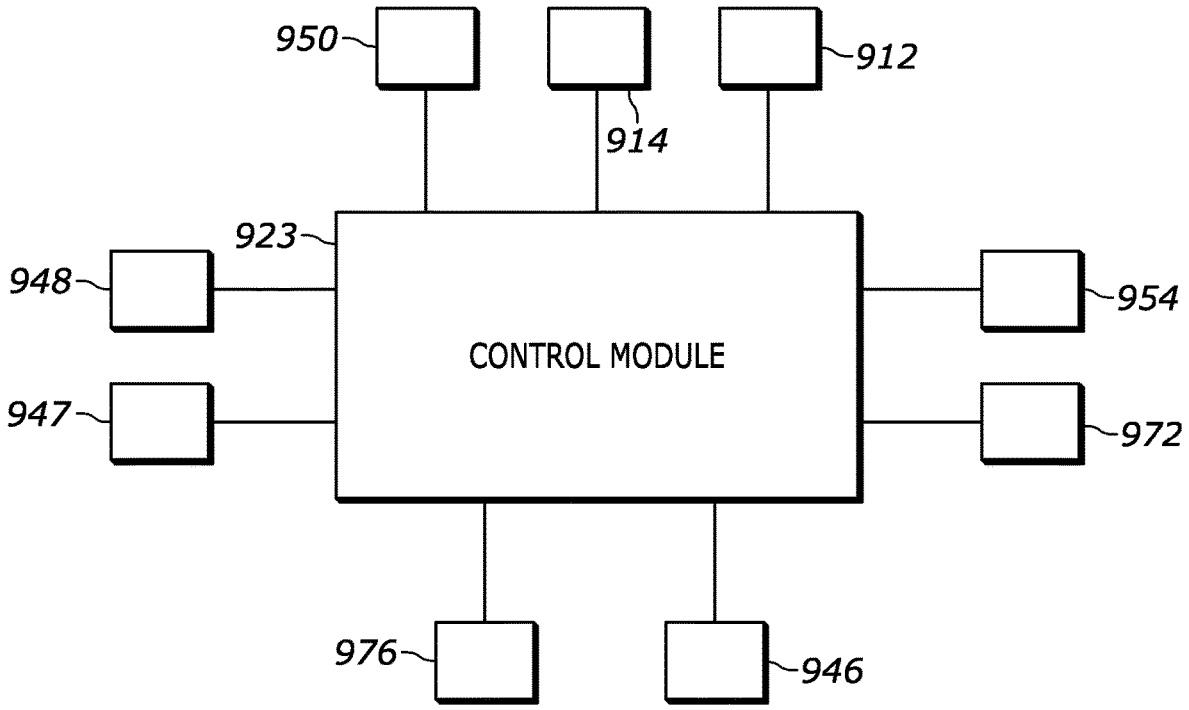
FIG. 15 is a block diagram illustrating communication between a control module and components of the climate-control system of FIG. 14.

With reference to FIGS. 14 and 15 another climate control system 910 is provided that may be generally similar to the climate-control systems 10, 310, 510, 710 described above, apart from any exceptions noted below. The climate-control system 910 may include a fluid-circuit having one or more first compressors 912, one or more second compressors 914, a first heat exchanger 916 (an outdoor heat exchanger such as a condenser or gas cooler, for example), a second heat exchanger 918, (an indoor heat exchanger such as a medium-temperature evaporator, for example) a third heat exchanger 920 (an indoor heat exchanger such as a low-temperature evaporator, for example) and a control module 923.

The structure and function of the first compressors 912 may be similar or identical to that of the first compressors 12, 312, 512, 712 described above, and therefore, will not be described again in detail. The structure and function of the second compressor 914 may be similar or identical to that of the second compressors 14, 314, 514, 714 described above, and therefore, will not be described again in detail. The structure and function of the first heat exchanger 916 may be similar or identical to that of the heat exchangers 16, 316, 516, 716 described above, and therefore, will not be described again in detail. The structure and function of the second heat exchanger 918 may be similar or identical to that of the heat exchangers 18, 318, 518, 718 described above, and therefore, will not be described again in detail. The structure and function of the third heat exchanger 920 may be similar or identical to that of the heat exchangers 20, 320, 520, 720 described above, and therefore, will not be described again in detail. The control module 923 may be similar or identical to that of the control modules 23, 323, 523, 723 described above, and therefore, will not be described again in detail.

The structure and function of a first expansion device 946 may be similar or identical to that of the expansion devices 46, 346, 546, 746 described above, and therefore, will not be described again in detail. The structure and function of a second expansion device 948 may be similar or identical to that of the expansion devices 48, 348, 548, 748 described above, and therefore will not be described again in detail. The structure and function of a first valve 947 may be similar or identical to that of the valves 47, 347, 547, 747 described above, and therefore, will not be described again in detail. The structure and function of a second valve 950 may be similar or identical to that of the valves 50, 350, 550, 750 described above, and therefore, will not be described again in detail.

The structure and function of an oil separator 952 may be similar or identical to that of the oil separators 552, 752 described above, and therefore, will not be described again in detail. The structure and function of a first oil-management valve device 954 may be similar or identical to that of devices 554, 754 described above, and therefore, will not be described again in detail. The structure and function of a second oil-management valve device 972 may be similar or identical to that of devices 572, 772 described above, and therefore, will not be described again in detail. The structure and function of a valve 976 may be similar or identical to that of the valves 576, 776 described above, and therefore, will not be described again in detail.

A first fluid passageway 981 may extend from the second heat exchanger 918 to suction lines 983 of the first compressors 912. A first oil passageway 984 may extend from the device 972 to the first fluid passageway 981 at a location between the second heat exchanger 920 and the first compressors 912.

Figure 16:
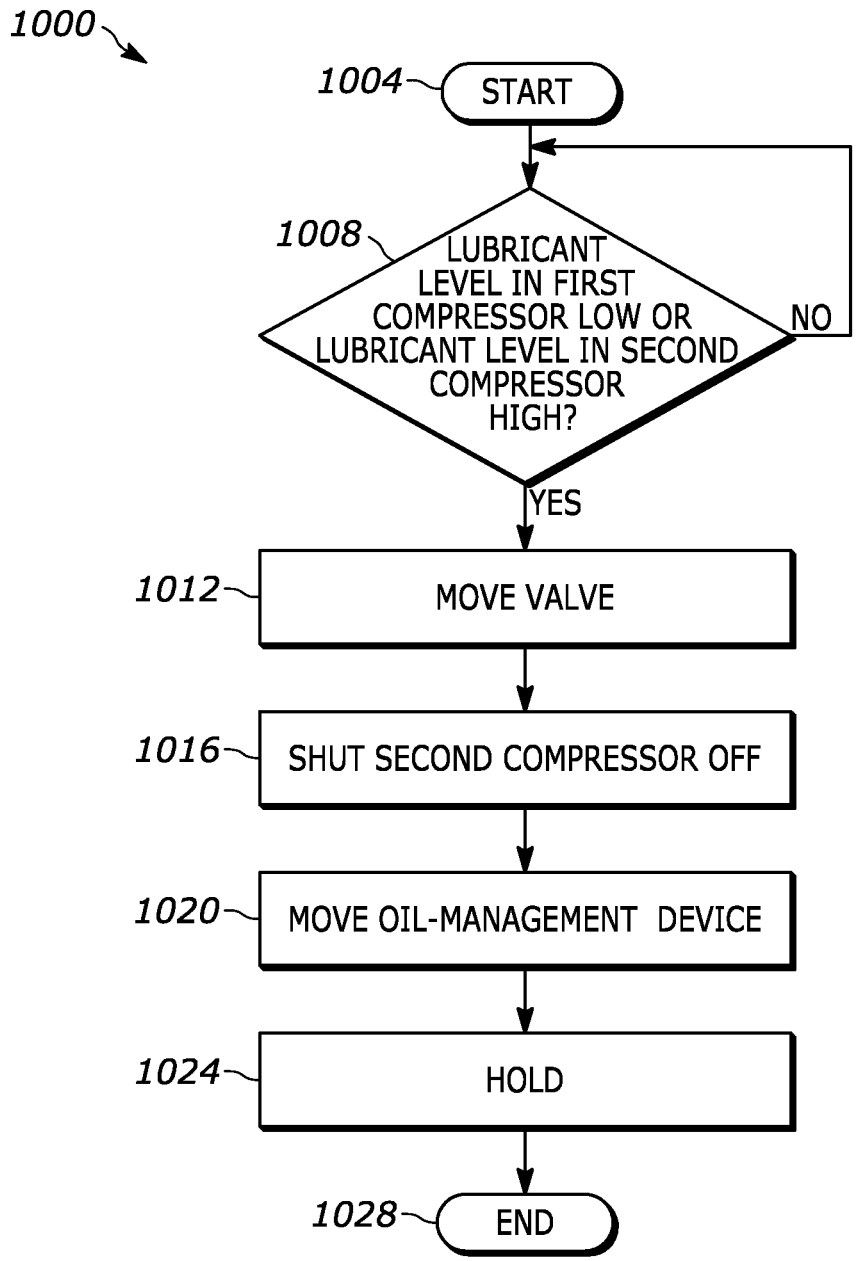
FIG. 16 is a flowchart depicting an algorithm for purging oil of one compressor to another compressor of the climate-control system of FIG. 14.

With reference to FIG. 16, a flowchart 1000 showing an example implementation of a control algorithm for oil purge in a refrigeration system is shown. The control algorithm begins at 1004. At 1008, the control algorithm, using the control module 923 determines if lubricant in the first compressors 912 is below a predetermined level or if the lubricant in the second compressor 914 is above a predetermined level. In some configurations, the lubricant purge may be on a schedule such as during defrost. If the lubricant in the first compressors 912 is below a predetermined level or if the lubricant in the second compressor 914 is above a predetermined level, the control algorithm proceeds to 1012; otherwise, the control algorithm remains at 1008 until the lubricant in the first compressors 912 is below a predetermined level or the second compressor 914 is above a predetermined level.

At 1012, the control algorithm, using the control module 923, moves the valve 976 to a closed position. In this way, compressed working fluid discharged from the second compressor 914 fills a reservoir 982 disposed along a discharge line 987 of the second compressor 914 at a location upstream of the valve 976. After moving the valve 976 to the closed position, the control algorithm proceeds to 1016.

At 1016, the control algorithm, using the control module 923, shuts the second compressor 914 to an OFF-mode. After shutting the second compressor 914 to the OFF-mode, the control algorithm then proceeds to 1020.

At 1020, the control algorithm, using the control module 923, moves the device 972 to an open position. In this way, lubricant may exit the second compressor 914 through the device 972. The compressed working fluid contained in the reservoir 982 bleeds or flows back to the second compressor 914 (via an outlet 992 of the second compressor 914). In this way, high pressure working fluid in the internal cavity of the second compressor forces lubricant out of the second compressor 914 (via the device 972) and into the first compressors 912 (via inlets 998). It should also be understood that the second compressor 914 does not include a check valve at a discharge fitting (not shown), which allows the high-pressure working fluid in the reservoir 982 to bleed or flow back into the second compressor 914, thereby forcing lubricant out of the second compressor 914 and into the first compressors 912.

A first check valve 999 is disposed downstream of the third heat exchanger 920 such that high pressure working fluid does not enter into the third heat exchanger 920 from the second compressor 914. A second check valve 953 is disposed along the first oil passageway 984 such that working fluid (and oil mixed within the working fluid) is prevented from flowing from the first fluid passageway 981 into the second compressor 914 via the device 972 while the second compressor is operating, but lubricant is allowed to be forced out of the second compressor 914 and into the first compressor 912 as described above. After moving the device 972 to the open position, the control algorithm proceeds to 1024.

At 1024, the control algorithm, using the control module 923, holds the valve 976 and the device 972 in the respective positions for a predetermined time period (e.g., 5 second, 10 seconds or any other suitable time period) before returning to their normal state (i.e., the state that the valve 976 and the device 972 were originally positioned). It should be understood that the device 972 and the valve 976 operate independently of each other, therefore, the device 972 may be held in the open position longer than the valve 976, for example. The control module 923 then proceeds to 1028 and ends.

Figure 17:
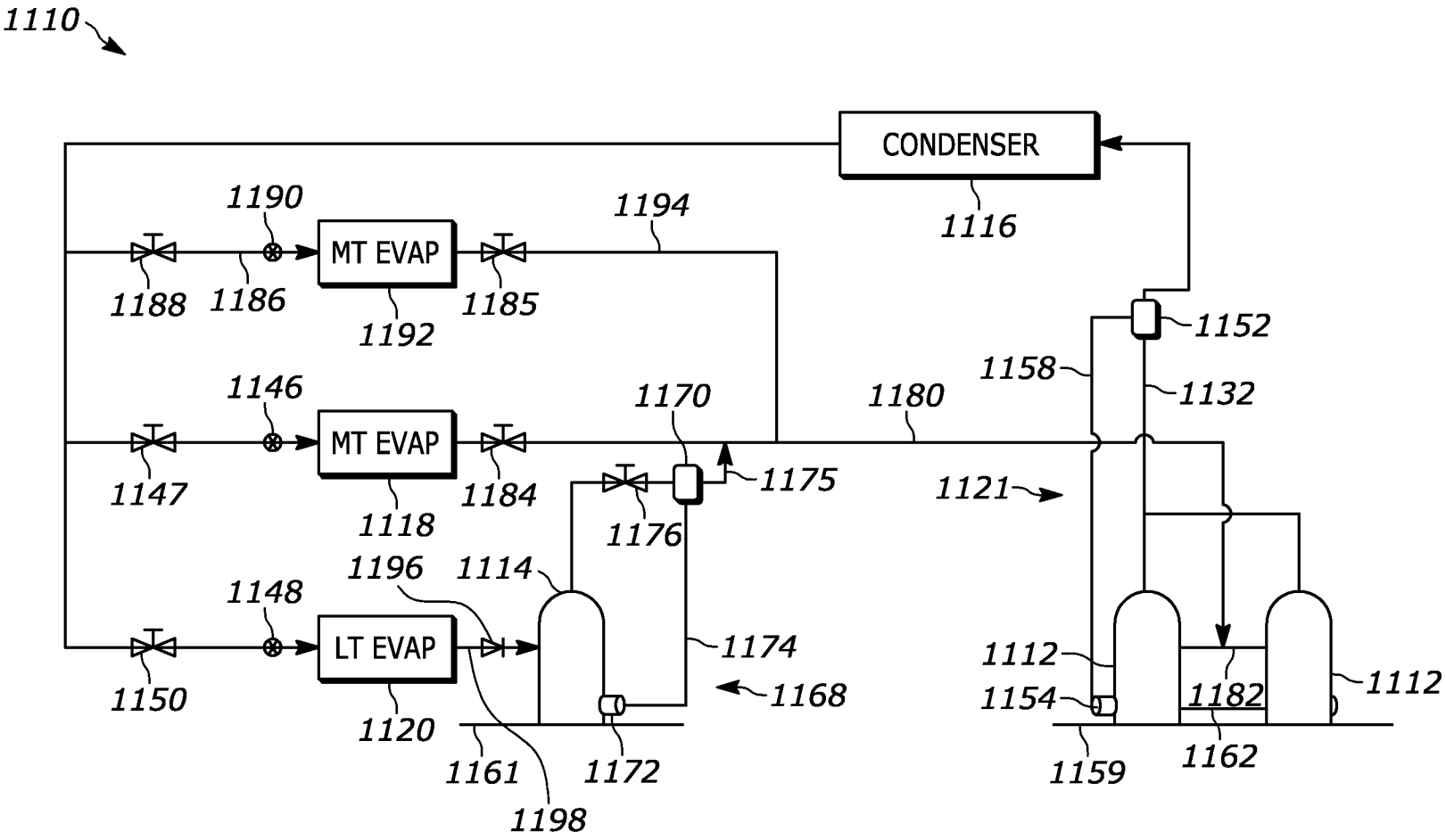
FIG. 17 is yet another schematic representation of a climate-control system.
Figure 18:
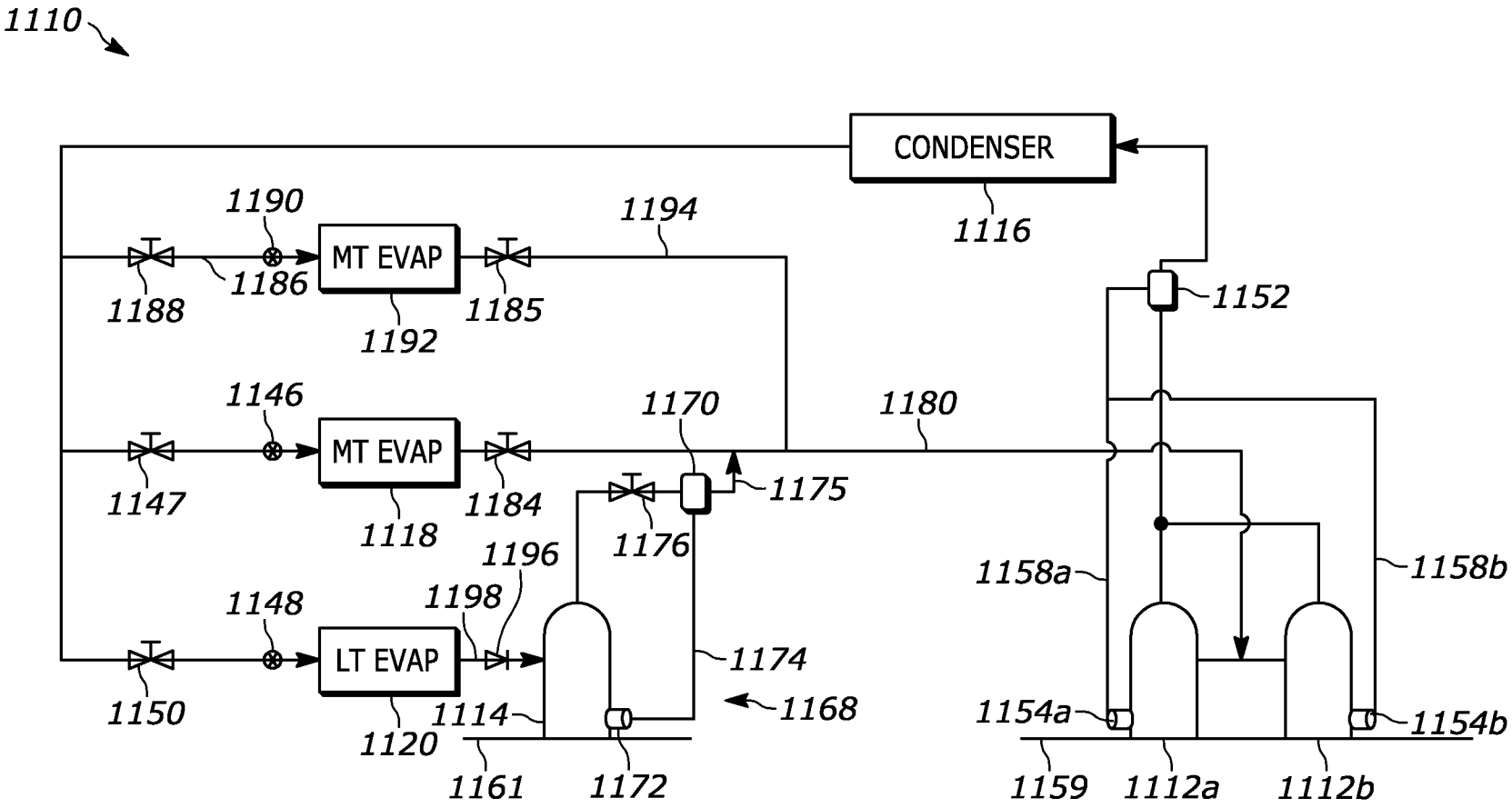
FIG. 18 is another schematic representation of a climate-control system.

With reference to FIGS. 17 and 18, another climate control system 1110 is provided that may be generally similar to the climate-control systems 10, 310, 510, 710, 910 described above, apart from any exceptions noted below. The climate-control system 1110 may include a fluid-circuit having one or more first compressors 1112, one or more second compressors 1114, a first heat exchanger 1116 (an outdoor heat exchanger such as a condenser or gas cooler, for example), a second heat exchanger 1118 (an indoor heat exchanger such as a medium-temperature evaporator, for example), a third heat exchanger 1120 (an indoor heat exchanger such as a low-temperature evaporator, for example) and a control module 1123.

The structure and function of the first compressors 1112 may be similar or identical to that of the first compressors 12, 312, 512, 712, 912 described above, and therefore, will not be described again in detail. The structure and function of the second compressor 1114 may be similar or identical to that of the second compressors 14, 314, 514, 714, 914 described above, and therefore, will not be described again in detail. The structure and function of the first heat exchanger 1116 may be similar or identical to that of the heat exchangers 16, 316, 516, 716, 916 described above, and therefore, will not be described again in detail. The structure and function of the second heat exchanger 1118 may be similar or identical to that of the heat exchangers 18, 318, 518, 718, 918 described above, and therefore, will not be described again in detail. The structure and function of the third heat exchanger 1120 may be similar or identical to that of the heat exchangers 20, 320, 520, 720, 920 described above, and therefore, will not be described again in detail. The control module 1123 may be similar or identical to that of the control modules 23, 323, 523, 723, 923 described above, and therefore, will not be described again in detail.

The structure and function of a first expansion device 1146 may be similar or identical to that of the expansion devices 46, 346, 546, 746, 946 described above, and therefore, will not be described again in detail. The structure and function of a second expansion device 1148 may be similar or identical to that of the expansion devices 48, 348, 548, 748, 948 described above, and therefore will not be described again in detail. The structure and function of a first valve 1147 may be similar or identical to that of the valves 47, 347, 547, 747, 947 described above, and therefore, will not be described again in detail. The structure and function of a second valve 1150 may be similar or identical to that of the valves 50, 350, 550, 750, 950 described above, and therefore, will not be described again in detail.

The first compressors 1112 may be on a base plate 1159 and the second compressor 1114 may be on a base plate 1161 that is at a remote location relative to the first compressors 1112. A first oil apparatus 1121 may include a first oil separator 1152, a first oil-management valve device 1154 and a first oil passageway 1158. The first oil separator 1152 is disposed along a discharge line 1132 of the first compressors 1112 such that compressed working fluid discharged from the first compressors 1112 passes through the first oil separator 1152 and the lubricant (e.g., oil) therein is entrapped in the first oil separator 1152.

A lubricant or oil equalization conduit 1162 may extend between the first compressors 1112 and may be in fluid communication with internal cavities (not shown) of the first compressors 1112. The first oil-management valve device 1154 is attached to the lubricant conduit 1162 and is in fluid communication with the lubricant conduit 1162. The device 1154 monitors the lubricant (e.g., oil) level within oil sumps (not shown) of the internal cavities of the first compressors 1112. The device 1154 may communicate data to the control module 1123 that the lubricant levels within the first compressors 1112 are above or below a predetermined level. The device 1154 may give off an alarm (via status lights) if the lubricant levels within the first compressors 1112 are above or below a predetermined level. The device 1154 may be movable between an open position in order to allow lubricant into or out of the first compressors 1112 and a closed position in order to prevent lubricant into or out of the first compressors 1112. The device 1154 may be movable between the open and closed positions by the control module 1123 or by the lubricant level within the oil sumps being above or below the predetermined levels.

A second oil apparatus 1168 may include a second oil separator 1170, a second oil-management valve device 1172 and a second oil passageway 1174. The second oil separator 1170 is disposed along a discharge line 1175 of the second compressor 1114 such that compressed working fluid discharged from the second compressor 1114 passes through the second oil separator 1170 and the lubricant (e.g., oil) therein is entrapped in the second oil separator 1170. A valve 1176 is disposed along the discharge line 1175 of the second compressor 1114 upstream of the second oil separator 1170 and is movable between open and closed positions.

The second oil-management valve device 1172 is attached to the second compressor 1114 and is in fluid communication with an internal cavity (not shown) of the second compressor 1114. The device 1172 monitors the lubricant (e.g., oil) level within an oil sump of the internal cavity of the second compressor 1114. The device 1172 may communicate data to the control module 1123 that the lubricant level within the second compressor 1114 is above or below a predetermined level. The device 1172 may give off an alarm (via status lights) if the lubricant level within the second compressor 1114 is above or below a predetermined level. The device 1172 may be movable between an open position in order to allow lubricant into or out of the second compressor 1114 and a closed position in order to prevent lubricant into or out of the second compressor 1114. The device 1172 may be movable between the open and closed positions by the control module 1123 or by the lubricant level within the oil sump being above or below the predetermined level.

The second oil passageway 1174 extends from the second oil separator 1170 to the device 1172. The second oil separator 1170 may be a bi-directional oil separator, for example. In this way, lubricant in the second oil separator 1170 may be allowed to flow to the second compressor 1114 (via the second oil passageway 1174 and the device 1172), and lubricant in the oil sump (not shown) of the second compressor 1114 may be allowed to flow to the second oil separator 1170 (via the device 1172 and the second oil passageway 1174). In some configurations (not shown), the second oil separator 1170 may be omitted. In such configurations, the second oil passageway 1174 will extend from the device 1172 to the discharge line 1175 of the second compressor at a location downstream of the valve 1176.

A first fluid passageway 1180 extends from the second heat exchanger 1118 to suction lines 1182 of the first compressors 1112. A valve 1184 is disposed along the first fluid passageway 1180 and is movable between open and closed positions. A second fluid passageway 1186 may include an expansion device 1190 (e.g., an electronic expansion valve, a thermal expansion valve or capillary tube) and a fourth heat exchanger 1192 (an indoor heat exchanger such as a medium-temperature evaporator, for example). A valve 1188 is disposed along the second fluid passageway 1186 at a location upstream of the expansion device 1190 and is movable between open and closed positions. From the first heat exchanger 1116, a portion of the working fluid flows into the second fluid passageway 1186. The working fluid in the second fluid passageway 1186 flows through the expansion device 1190 where its temperature and pressure is lowered. In the fourth heat exchanger 1192, the working fluid may absorb heat from a space to be cooled (e.g., an interior or a refrigerator, a refrigerated display case, or a cooler).

From the fourth heat exchanger 1192, the working fluid flows to the first fluid passageway 1180 (via a third fluid passageway 1194) where it mixes with the working fluid exiting the second heat exchanger 1118. A valve 1185 is disposed along the third fluid passageway 1194 and is movable between open and closed positions. It should be understood that although the system 1110 includes two medium temperature heat exchangers 1118, 1192 and one low-temperature heat exchanger 1120, the system 1110 may include any number of medium temperature heat exchangers and low-temperature heat exchangers according to the principles disclose herein.

In some configurations, as shown in FIG. 18, each first compressor 1112*a*, 1112*b* may include oil-management valve devices 1154*a*, 1154*b*, respectively. That is, the oil-management valve device 1154*a* may be attached to the first compressor 1112*a* and may be in fluid communication with an oil sump (and an internal cavity) of the first compressor 1112*a*. The device 1154*a* may also be in fluid communication with the first oil separator 1152 via an oil passageway 1158*a*. Similarly, the oil-management valve device 1154*b* may be attached to the first compressor 1112*b* and may be in fluid communication with an oil sump (and an internal cavity) of the first compressor 1112*b*. The device 1154*b* may also be in fluid communication with the first oil separator 1152 via an oil passageway 1158*b*. In this way, the lubricant levels within each compressor 1112*a*, 1112*b* may be monitored individually and filled separately, for example.

Figure 19:
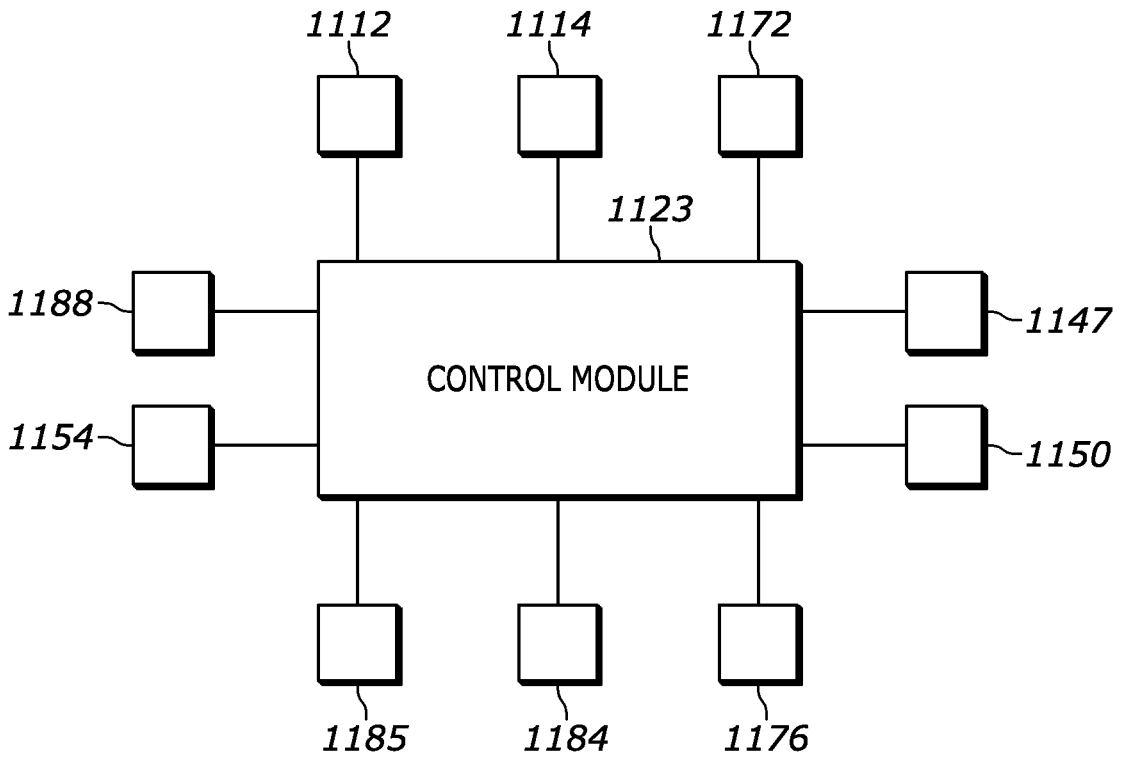
FIG. 19 is a block diagram illustrating communication between a control module and components of the climate-control system of FIG. 17.

As shown in FIG. 19, the control module 1123 may be in communication with the first compressors 1112, the second compressor 1114, the valves 1147, 1150, 1176, 1184, 1185, 1188 and the devices 1154, 1172, for example. The control module 1123 may control operation of the first compressors 1112, the second compressor 1114, the valves 1147, 1150, 1176, 1184, 1185, 1188 and the devices 1154, 1172 based at least partially on lubricant levels within the first and second compressors 1112, 1114. Based on the lubricant levels within the first and second compressors 1112, 1114, the control module 1123 can open and close the valves 1147, 1150, 1176, 1184, 1185, 1188 and the devices 1154, 1172, and can control operation of the first and second compressors 1112, 1114.

Figure 20:
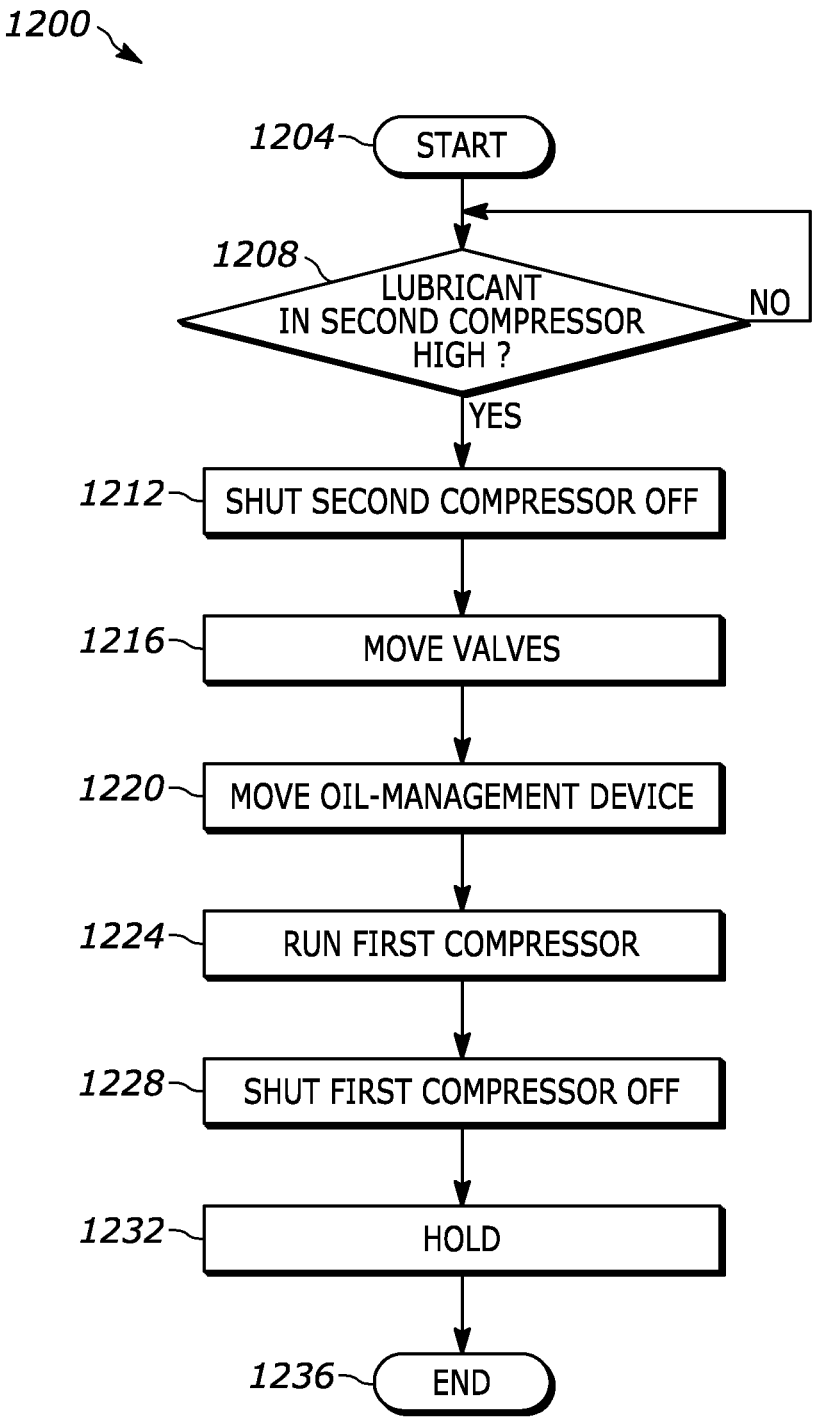
FIG. 20 is a flowchart depicting an algorithm for purging oil of one compressor to another compressor of the climate-control system of FIG. 17.

With reference to FIG. 20, a flowchart 1200 showing an example implementation of a control algorithm for oil purge in a refrigeration system is shown. The control algorithm begins at 1204. At 1208, the control algorithm, using the control module 1123 determines if lubricant in the second compressor 1114 is above a predetermined level. In some configurations, the lubricant purge may be on a schedule such as during defrost. If the lubricant in the second compressor 1114 is above a predetermined level, the control algorithm proceeds to 1212; otherwise, the control algorithm remains at 1208 until the lubricant in the second compressor 1114 is above a predetermined level.

At 1212, the control algorithm, using the control module 1123, shuts the second compressor 1114 to an OFF-mode. This causes the pressure in the second compressor 1114 and in the third heat exchanger 1120 to increase such that the pressure is equal or nearly equal to the pressure in the first compressors 1112. After shutting the second compressor 1114 to the OFF-mode, the control algorithm then proceeds to 1216.

At 1216, the control algorithm, using the control module 1123, moves the valves 1176, 1184, 1185 from the open position to the closed position and one of the valve 1150 and the expansion device 1148 from the open position to the closed position. That is, if the device 1148 is an electronic expansion device, then the device 1148 is moved to the closed position, and if the device 1148 is a thermal expansion device, then the valve 1150 is moved to the closed position. It should be understood that the valves 1176, 1184, 1185 and the one of the valve 1150 and the expansion device 1148 may be moved simultaneously or in a sequence (e.g., moving the valve 1176 to the closed position, then moving the valve 1184 to the closed position, then moving the valve 1185 to the closed position and finally moving the one of the valve 1150 and the expansion device 1148 to the closed position). After moving the valves 1176, 1184, 1185 and the one of the valve 1150 and the expansion device 1148, the control algorithm then proceeds to 1220.

At 1220, the control algorithm, using the control module 1123, moves the device 1172 to an open position. In some configurations, the device 1172 may be moved to the open position and the valves 1176, 1184, 1185 may be moved to the closed position simultaneously. After moving the device 1172 to the open positon, the control algorithm then proceeds to 1224.

At 1224, the control algorithm, using the control module 1123, runs the first compressors 1112 for a predetermined time period (e.g., 30 seconds, 1 minute or any other suitable time) or until the first compressors 1112 reaches a predetermined pressure setting. In this way, each of the first compressors 1112 pumps down such that the pressure in the first compressors 1112 drops below the pressure in the second compressor 1114. After running the first compressors 1112 for a predetermined time period or until the first compressor 1112 reaches a predetermined pressure setting, the control algorithm then proceeds to 1228.

At 1228, the control algorithm, using the control module 1123, shuts the first compressor 1112 to an OFF-mode. In this way, lubricant in the second compressor 1114 is purged out and into the second oil separator 1170 via the device 1172 and the second oil passageway 1174. That is, pressure of working fluid in the second compressor 1114 is greater than the pressure of working fluid in the first compressors 1112, which forces the lubricant out of the second compressor 1114 and into the second oil separator 1170. In some configurations, a check valve 1196 may be disposed along the suction line 1198 to prevent working fluid from entering the third heat exchanger 1120. It is understood that the check valve 1196 is optional and may be omitted in other configurations. In the event that the second oil separator 1170 is omitted (see above), the lubricant forced out of the second compressor 1114 will flow into the first compressors 1112 via the discharge line 1175 and the first fluid passageway 1180. After shutting the first compressors 1112 to the OFF-mode, the control algorithm then proceeds to 1232.

At 1232, the control algorithm, using the control module 1123, holds the system in position (i.e., holds the valves 1176, 1184, 1185, the device 1172 and the one of the valve 1150 and the expansion device 1148 in the respective positions and the first and second compressors 1112, 1114 in the OFF-mode) for a predetermined time period (e.g., 5 second, 10 seconds or any other suitable time period) or until lubricant in the second compressor 1114 returns to a predetermined level. The system may then be returned to its normal state (i.e., the state that the valves 1176, 1184, 1185, the device 1172 and the one of the valve 1150 and the expansion device 1148 were originally positioned and starting the first and second compressors 1112, 1114). The control module 1123 then proceeds to 1236 and ends.

Figure 21:
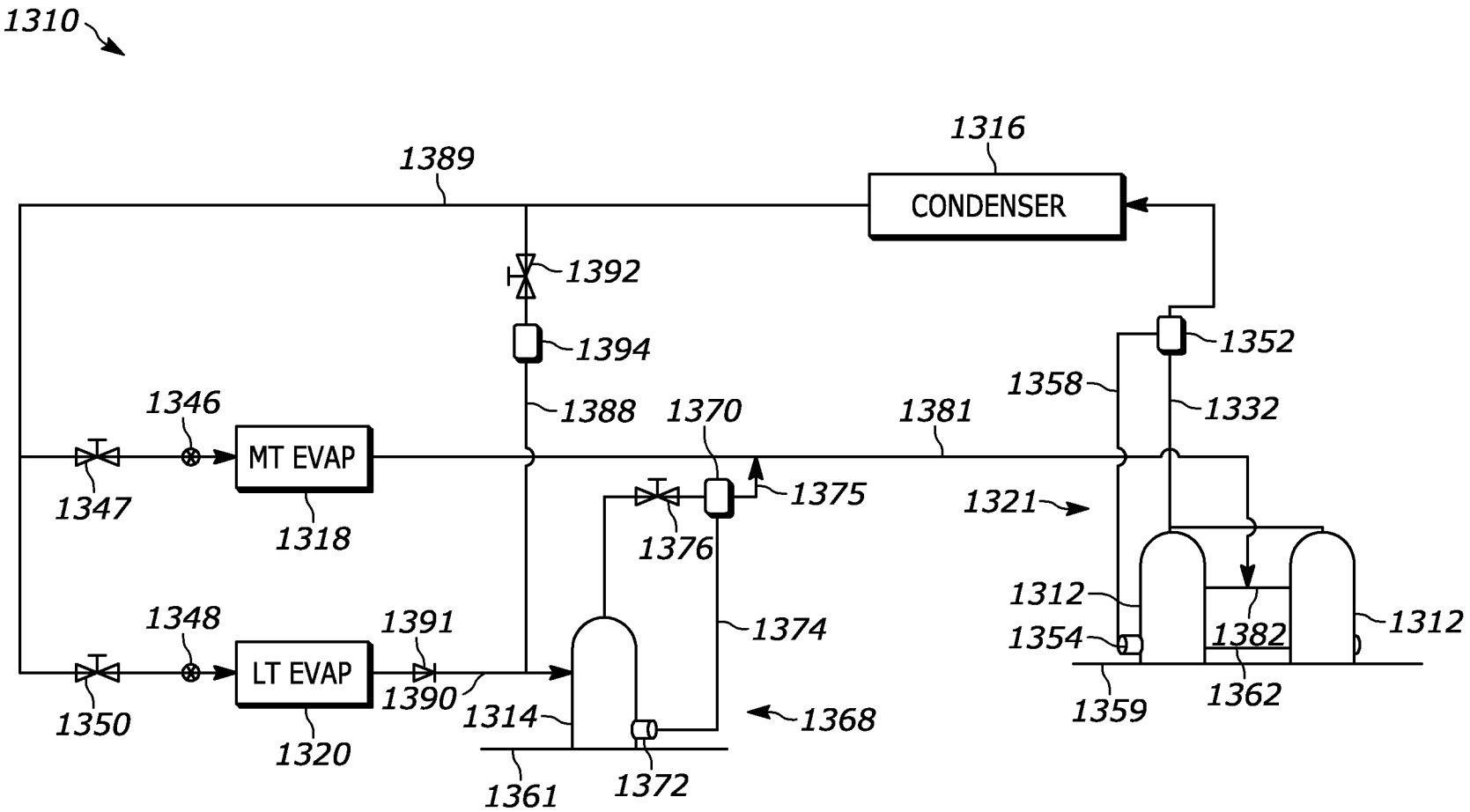
FIG. 21 is yet another schematic representation of a climate-control system.
Figure 22:
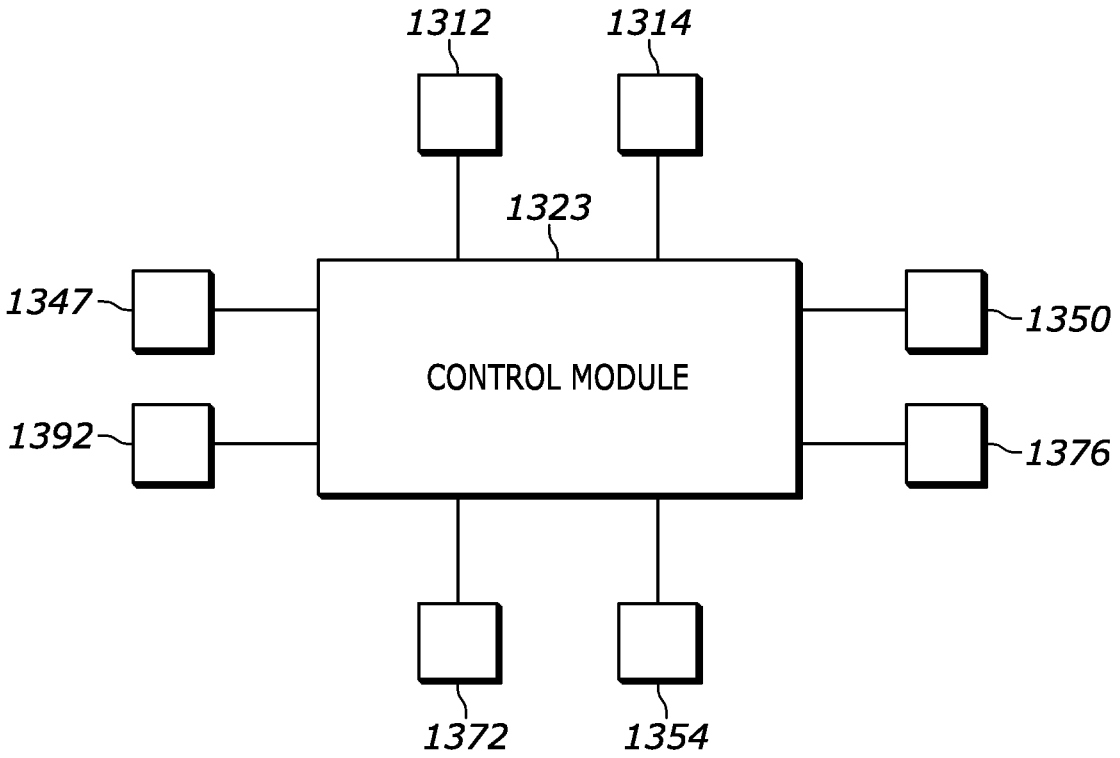
FIG. 22 is a block diagram illustrating communication between a control module and components of the climate-control system of FIG. 21.

With reference to FIGS. 21 and 22, another climate control system 1310 is provided that may be generally similar to the climate-control systems 10, 310, 510, 710, 910, 1110 described above, apart from any exceptions noted below. The climate-control system 1310 may include a fluid-circuit having one or more first compressors 1312, one or more second compressors 1314, a first heat exchanger 1316 (an outdoor heat exchanger such as a condenser or gas cooler, for example), a second heat exchanger 1318, (an indoor heat exchanger such as a medium-temperature evaporator, for example) a third heat exchanger 1320 (an indoor heat exchanger such as a low-temperature evaporator, for example) and a control module 1323.

The structure and function of the first compressors 1312 may be similar or identical to that of the first compressors 12, 312, 512, 712, 912, 1112 described above, and therefore, will not be described again in detail. The structure and function of the second compressor 1314 may be similar or identical to that of the second compressors 14, 314, 514, 714, 914, 1114 described above, and therefore, will not be described again in detail. The structure and function of the first heat exchanger 1316 may be similar or identical to that of the heat exchangers 16, 316, 516, 716, 916, 1116 described above, and therefore, will not be described again in detail. The structure and function of the second heat exchanger 1318 may be similar or identical to that of the heat exchangers 18, 318, 518, 718, 918, 1118 described above, and therefore, will not be described again in detail. The structure and function of the third heat exchanger 1320 may be similar or identical to that of the heat exchangers 20, 320, 520, 720, 920, 1120 described above, and therefore, will not be described again in detail. The control module 1323 may be similar or identical to that of the control modules 23, 323, 523, 723, 923, 1123 described above, and therefore, will not be described again in detail.

The structure and function of a first expansion device 1346 may be similar or identical to that of the expansion devices 46, 346, 546, 746, 946, 1146 described above, and therefore, will not be described again in detail. The structure and function of a second expansion device 1348 may be similar or identical to that of the expansion devices 48, 348, 548, 748, 948, 1348 described above, and therefore will not be described again in detail. The structure and function of a first valve 1347 may be similar or identical to that of the valves 47, 347, 547, 747, 947, 1147 described above, and therefore, will not be described again in detail. The structure and function of a second valve 1350 may be similar or identical to that of the valves 50, 350, 550, 750, 950, 1150 described above, and therefore, will not be described again in detail.

The first compressors 1312 may be on a base plate 1359 and the second compressor 1314 may be on a base plate 1361 that is at a remote location relative to the first compressors 1312. A first oil apparatus 1321 may include a first oil separator 1352, a first oil-management valve device 1354 and a first oil passageway 1358. The first oil separator 1352 is disposed along a discharge line 1332 of the first compressors 1312 such that compressed working fluid discharged from the first compressors 1312 passes through the first oil separator 1352 and the lubricant (e.g., oil) therein is entrapped in the first oil separator 1352.

A lubricant or oil equalization conduit 1362 may extend between the first compressors 1312 and may be in fluid communication with internal cavities (not shown) of the first compressors 1312. The first oil-management valve device 1354 is attached to the lubricant conduit 1362 and is in fluid communication with the lubricant conduit 1362. The device 1354 monitors the lubricant (e.g., oil) level within oil sumps (not shown) of the internal cavities of the first compressors 1312. The device 1354 may communicate data to the control module 1323 that the lubricant levels within the first compressors 1312 are above or below a predetermined level. The device 1354 may give off an alarm (via status lights) if the lubricant levels within the first compressors 1312 are above or below a predetermined level. The device 1354 may be movable between an open position in order to allow lubricant into or out of the first compressors 1312 and a closed position in order to prevent lubricant into or out of the first compressors 1312. The device 1354 may be movable between the open and closed positions by the control module 1323 or by the lubricant level within the oil sumps being above or below the predetermined levels.

A second oil apparatus 1368 may include a second oil separator 1370, a second oil-management valve device 1372 and a second oil passageway 1374. The second oil separator 1370 is disposed along a discharge line 1375 of the second compressor 1314 such that compressed working fluid discharged from the second compressor 1314 passes through the second oil separator 1370 and the lubricant (e.g., oil) therein is entrapped in the second oil separator 1370. The second oil separator 1370 may be a bi-directional oil separator, for example. In this way, lubricant in the second oil separator 1370 may be allowed to flow to the second compressor 1314, and lubricant in the oil sump (not shown) of the second compressor 1314 may be allowed to flow to the second oil separator 1370. A valve 1376 is disposed along the discharge line 1375 of the second compressor 1314 at a location upstream of the second oil separator 1370 and is movable between open and closed positions. The second oil passageway 1374 extends from the device 1372 to the second oil separator 1370.

The second oil-management valve device 1372 is attached to the second compressor 1314 and is in fluid communication with an internal cavity (not shown) of the second compressor 1314. The device 1372 monitors the lubricant (e.g., oil) level within an oil sump of the internal cavity of the second compressor 1314. The device 1372 may communicate data to the control module 1323 that the lubricant level within the second compressor 1314 is above or below a predetermined level. The device 1372 may give off an alarm (via status lights) if the lubricant level within the second compressor 1314 is above or below a predetermined level. The device 1372 may be movable between an open position in order to allow lubricant into or out of the second compressor 1314 and a closed position in order to prevent lubricant into or out of the second compressor 1314. The device 1372 may be movable between the open and closed positions by the control module 1323 or by the lubricant level within the oil sump being above or below the predetermined level.

A first fluid passageway 1381 extends from the second heat exchanger 1318 to suction lines 1382 of the first compressors 1312. A second fluid passageway 1388 extends from a third fluid passageway 1389 at a location downstream of the first heat exchanger 1316 to a suction line 1390 of the second compressor 1314. A valve 1392 is disposed along the second fluid passageway 1388 and is movable between open and closed positions. An accumulator 1394 is also disposed along the second fluid passageway 1388 at a location downstream of the valve 1392 and may remove liquid from working fluid passing therethrough such that liquid does not enter into the second compressor 1314.

As shown in FIG. 22, the control module 1323 may be in communication with the first compressors 1312, the second compressor 1314, the valves 1347, 1350, 1376, 1392 and the devices 1354, 1372, for example. The control module 1323 may control operation of the first compressors 1312, the second compressor 1314, the valves 1347, 1350, 1376, 1392 and the devices 1354, 1372 based at least partially on lubricant levels within the first and second compressors 1312, 1314. Based on the lubricant levels within the first and second compressors 1312, 1314, the control module 1323 can open and close the valves 1347, 1350, 1376 1392 and the devices 1354, 1372, and can control operation of the first and second compressors 1312, 1314.

Figure 23:
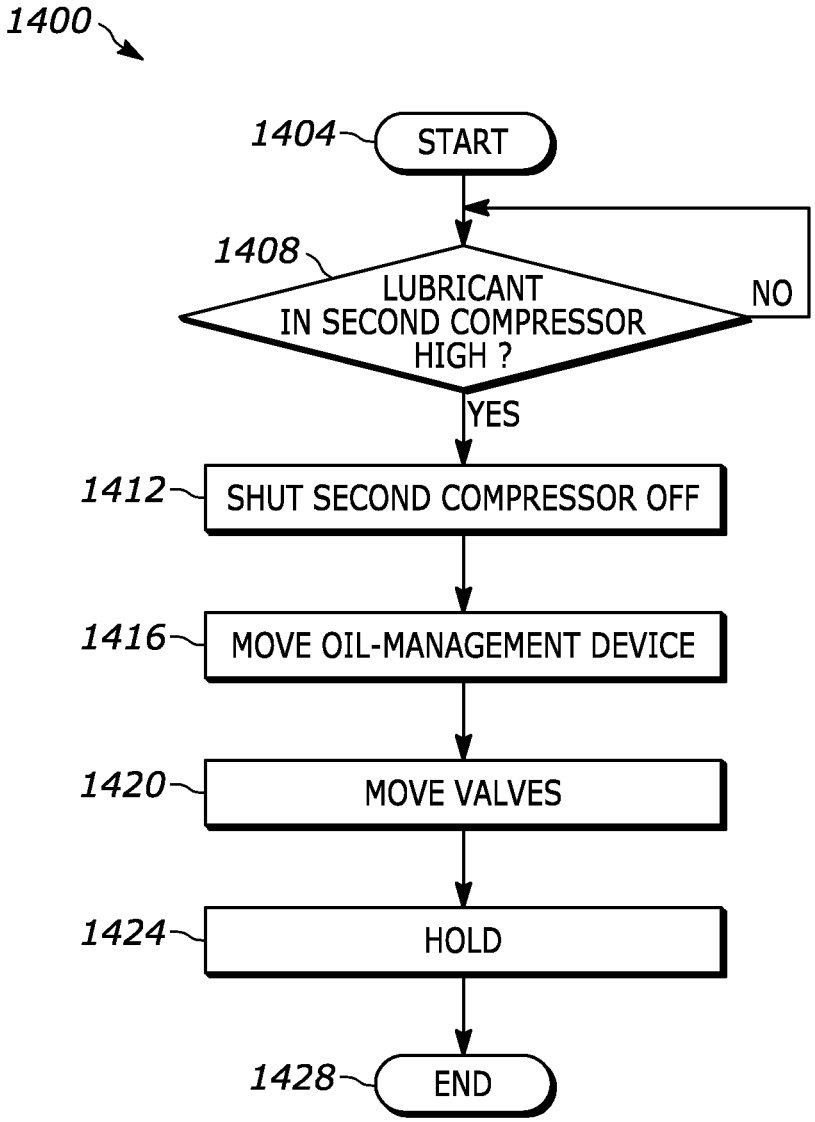
FIG. 23 is a flowchart depicting an algorithm for purging oil of one compressor to another compressor of the climate-control system of FIG. 21.

With reference to FIG. 23, a flowchart 1400 showing an example implementation of a control algorithm for oil purge in a refrigeration system is shown. The control algorithm begins at 1404. At 1408, the control algorithm, using the control module 1323 determines if lubricant in the second compressor 1314 is above a predetermined level. In some configurations, the lubricant purge may be on a schedule such as during defrost. If lubricant in the second compressor 1314 is above a predetermined level, the control algorithm proceeds to 1412; otherwise, the control algorithm remains at 1408 until the lubricant in the second compressor 1314 is above a predetermined level.

At 1412, the control algorithm, using the control module 1323, shuts the second compressor 1314 to an OFF-mode. After shutting the second compressor 1314 to the OFF-mode, the control algorithm then proceeds to 1416.

At 1416, the control algorithm, using the control module 1323, moves the device 1372 to an open position. In this way, lubricant may exit the second compressor 1314 through the device 1372. After moving the device 1372 to the open positon, the control algorithm then proceeds to 1420.

At 1420, the control algorithm, using the control module 1323, moves the valves 1376, 1392. That is, valve 1376 is moved from the open position to the closed position and the valve 1392 is moved from the closed position to the open position. It should be understood that the valves 1376, 1392 may be moved simultaneously or in a sequence (e.g., moving the valve 1392 to the open position, then moving the valve 1376 to the closed position).

Moving the valve 1392 to the open position allows a portion of the working fluid exiting the first heat exchanger 1316 to flow into the second compressor 1314 (via the second fluid passageway 1388 and the suction line 1390 of the second compressor 1314), which forces lubricant out of the second compressor 1314 and into the second oil separator 1370 via the device 1372 and the second oil passageway 1374. A check valve 1391 disposed along the suction line 1390 prevents the working fluid from entering the third heat exchanger 1320. After moving the valves 1376, 1392, the control algorithm then proceeds to 1424.

At 1424, the control algorithm, using the control module 1323, holds the valves 1376, 1392 and the device 1372 in the respective positions for a predetermined time period (e.g., 5 second, 10 seconds or any other suitable time period). The valves 1376, 1392 and the device 1372 may then be returned to their normal state (i.e., the state that the valves 1376, 1392 and the device 1372 were originally positioned). In some configurations, the valve 1392 may be closed before returning the valve 1376 and the device 1372 to their normal state. The control module 1323 then proceeds to 1428 and ends.

Figure 24:
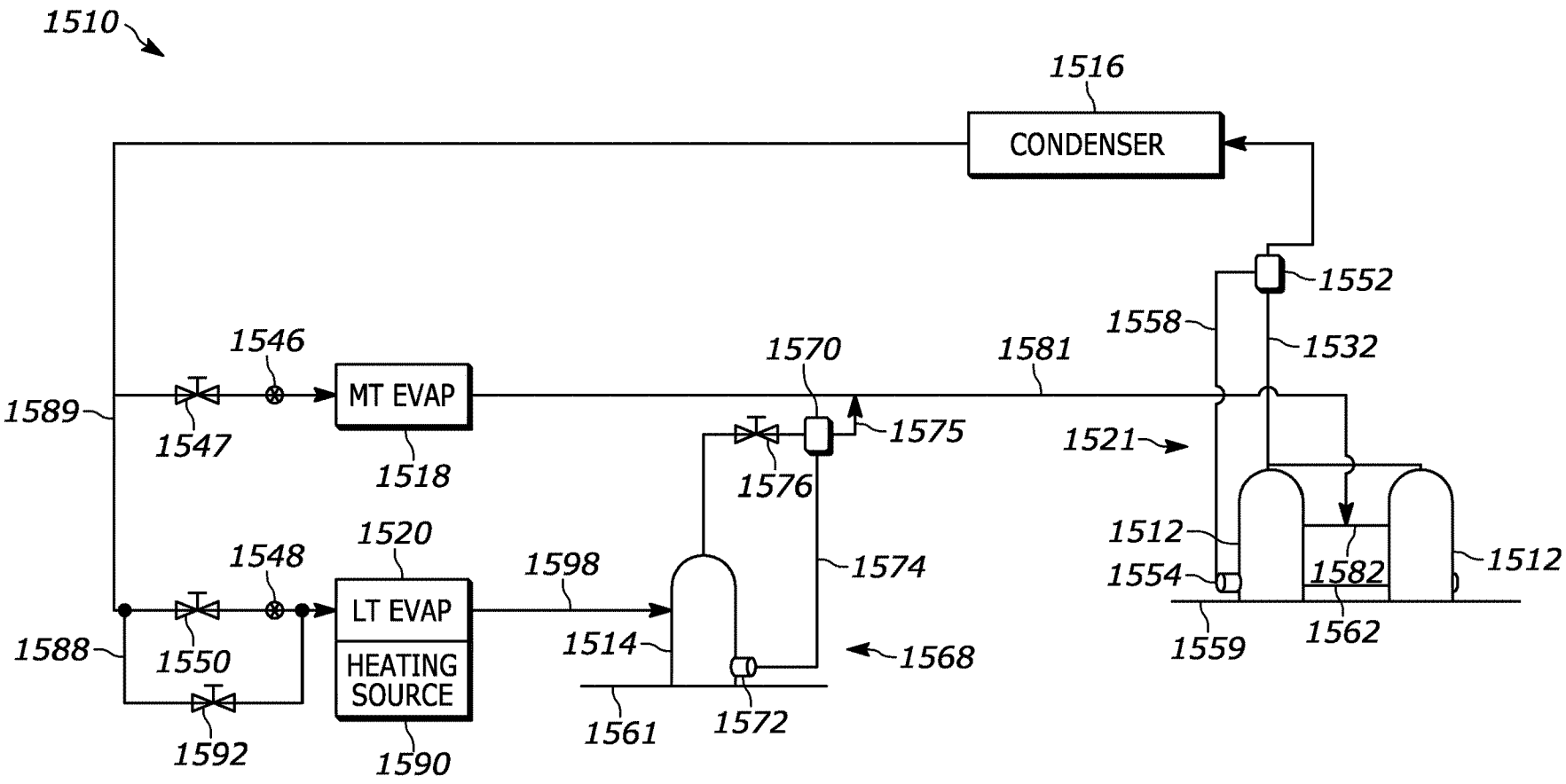
FIG. 24 is yet another schematic representation of a climate-control system.
Figure 25:
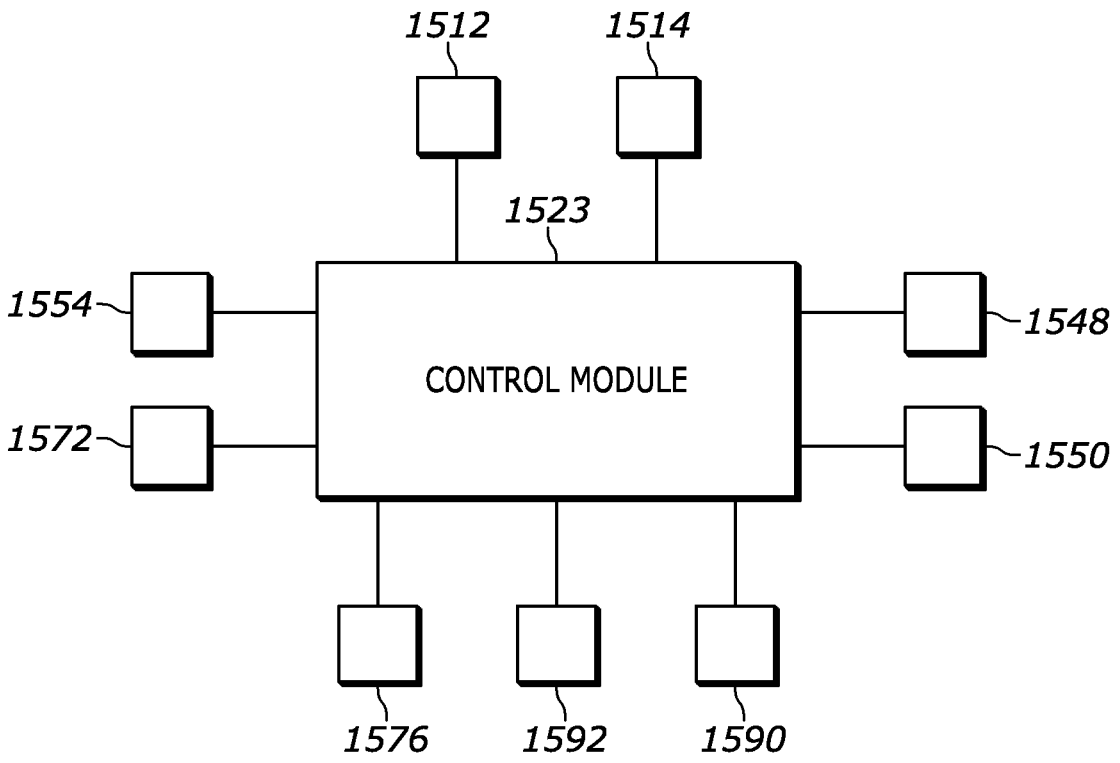
FIG. 25 is a block diagram illustrating communication between a control module and components of the climate-control system of FIG. 24.

With reference to FIGS. 24 and 25, another climate control system 1510 is provided that may be generally similar to the climate-control systems 10, 310, 510, 710, 910, 1110, 1310 described above, apart from any exceptions noted below. The climate-control system 1510 may include a fluid-circuit having one or more first compressors 1512, one or more second compressors 1514, a first heat exchanger 1516 (an outdoor heat exchanger such as a condenser or gas cooler, for example), a second heat exchanger 1518, (an indoor heat exchanger such as a medium-temperature evaporator, for example) a third heat exchanger 1520 (an indoor heat exchanger such as a low-temperature evaporator, for example) and a control module 1523.

The structure and function of the first compressors 1512 may be similar or identical to that of the first compressors 12, 312, 512, 712, 912, 1112, 1312 described above, and therefore, will not be described again in detail. The structure and function of the second compressor 1514 may be similar or identical to that of the second compressors 14, 314, 514, 714, 914, 1114, 1314 described above, and therefore, will not be described again in detail. The structure and function of the first heat exchanger 1516 may be similar or identical to that of the heat exchangers 16, 316, 516, 716, 916, 1116, 1316 described above, and therefore, will not be described again in detail. The structure and function of the second heat exchanger 1518 may be similar or identical to that of the heat exchangers 18, 318, 518, 718, 918, 1118, 1318 described above, and therefore, will not be described again in detail. The structure and function of the third heat exchanger 1520 may be similar or identical to that of the heat exchangers 20, 320, 520, 720, 920, 1120, 1320 described above, and therefore, will not be described again in detail. The control module 1523 may be similar or identical to that of the control modules 23, 323, 523, 723, 923, 1123, 1323 described above, and therefore, will not be described again in detail.

The structure and function of a first expansion device 1546 may be similar or identical to that of the expansion devices 46, 346, 546, 746, 946, 1146, 1346 described above, and therefore, will not be described again in detail. The structure and function of a second expansion device 1548 may be similar or identical to that of the expansion devices 48, 348, 548, 748, 948, 1348 described above, and therefore will not be described again in detail. The structure and function of a first valve 1547 may be similar or identical to that of the valves 47, 347, 547, 747, 947, 1147, 1347 described above, and therefore, will not be described again in detail. The structure and function of a second valve 1550 may be similar or identical to that of the valves 50, 350, 550, 750, 950, 1150, 1350 described above, and therefore, will not be described again in detail.

The first compressors 1512 may be on a base plate 1559 and the second compressor 1514 may be on a base plate 1561 that is at a remote location relative to the first compressors 1512. A first oil apparatus 1521 may include a first oil separator 1552, a first oil-management valve device 1554 and a first oil passageway 1558. The first oil separator 1552 is disposed along a discharge line 1532 of the first compressors 1512 such that compressed working fluid discharged from the first compressors 1512 passes through the first oil separator 1552 and the lubricant (e.g., oil) therein is entrapped in the first oil separator 1552.

A lubricant or oil equalization conduit 1562 may extend between the first compressors 1512 and may be in fluid communication with internal cavities (not shown) of the first compressors 1512. The first oil-management valve device 1554 is attached to the lubricant conduit 1562 and is in fluid communication with the lubricant conduit 1562. The device 1554 monitors the lubricant (e.g., oil) level within oil sumps (not shown) of the internal cavities of the first compressors 1512. The device 1554 may communicate data to the control module 1523 that the lubricant levels within the first compressors 1512 are above or below a predetermined level. The device 1554 may give off an alarm (via status lights) if the lubricant levels within the first compressors 1512 are above or below a predetermined level. The device 1554 may be movable between an open position in order to allow lubricant into or out of the first compressors 1512 and a closed position in order to prevent lubricant into or out of the first compressors 1512. The device 1554 may be movable between the open and closed positions by the control module 1523 or by the lubricant level within the oil sumps being above or below the predetermined levels.

A second oil apparatus 1568 may include a second oil separator 1570, a second oil-management valve device 1572 and a second oil passageways 1574. The second oil separator 1570 is disposed along a discharge line 1575 of the second compressor 1514 such that compressed working fluid discharged from the second compressor 1514 passes through the second oil separator 1570 and the lubricant (e.g., oil) therein is entrapped in the second oil separator 1570. The second oil separator 1570 may be a bi-directional oil separator, for example. In this way, lubricant in the second oil separator 1570 may be allowed to flow to the second compressor 1514, and lubricant in the oil sump (not shown) of the second compressor 1514 may be allowed to flow to the second oil separator 1570. A valve 1576 is disposed along the discharge line 1575 of the second compressor 1514 at a location upstream of the second oil separator 1570 and is movable between open and closed positions. The second oil passageway 1574 extends from the device 1572 and to the second oil separator 1570.

The second oil-management valve device 1572 is attached to the second compressor 1514 and is in fluid communication with an internal cavity (not shown) of the second compressor 1514. The device 1572 monitors the lubricant (e.g., oil) level within an oil sump of the internal cavity of the second compressor 1514. The device 1572 may communicate data to the control module 1523 that the lubricant level within the second compressor 1514 is above or below a predetermined level. The device 1572 may give off an alarm (via status lights) if the lubricant level within the second compressor 1514 is above or below a predetermined level. The device 1572 may be movable between an open position in order to allow lubricant into or out of the second compressor 1514 and a closed position in order to prevent lubricant into or out of the second compressor 1514. The device 1572 may be movable between the open and closed positions by the control module 1523 or by the lubricant level within the oil sump being above or below the predetermined level.

A first fluid passageway 1581 extends from the second heat exchanger 1518 to suction lines 1582 of the first compressors 1512. If the device 1548 is a thermal expansion valve, then a bypass passageway 1588 may extend from a third fluid passageway 1589 at a location upstream of the valve 1150 to a location of the third fluid passageway 1589 between the third heat exchanger 1520 and the expansion device 1548. A valve 1592 is disposed along the bypass passageway 1588 and is movable between open and closed positions. It is understood that the bypass passageway 1588 and valve 1592 may be omitted if the device 1548 is an electronic expansion valve.

A heating source 1590 may be associated with the third heat exchanger 1520 and may be configured to heat coils (not shown) of third heat exchanger 1520 to melt ice or frost, for example, formed thereon. For example, the heating source 1590 may blow hot air over the coils. In another example, the heating source 1590 may include coils (not shown) that are in close proximity to the coils of the third heat exchanger 1520 and that heat the coils of the third heat exchanger 1520 when the heating source 1590 is turned to an ON-mode.

As shown in FIG. 25, the control module 1523 may be in communication with the first compressors 1512, the second compressor 1514, the valves 1548, 1550, 1576, 1592, the devices 1554, 1572 and the heating source 1590, for example. The control module 1523 may control operation of the first compressors 1512, the second compressor 1514, the valves 1548, 1550, 1576, 1592, the devices 1554, 1572 and the heating source 1590 based at least partially on lubricant levels within the first and second compressors 1512, 1514. Based on the lubricant levels within the first and second compressors 1512, 1514, the control module 1523 can open and close the valves 1548, 1550, 1576, 1592 and the devices 1554, 1572, and can control operation of the first and second compressors 1512, 1514 and the heating source 1590.

Figure 26:
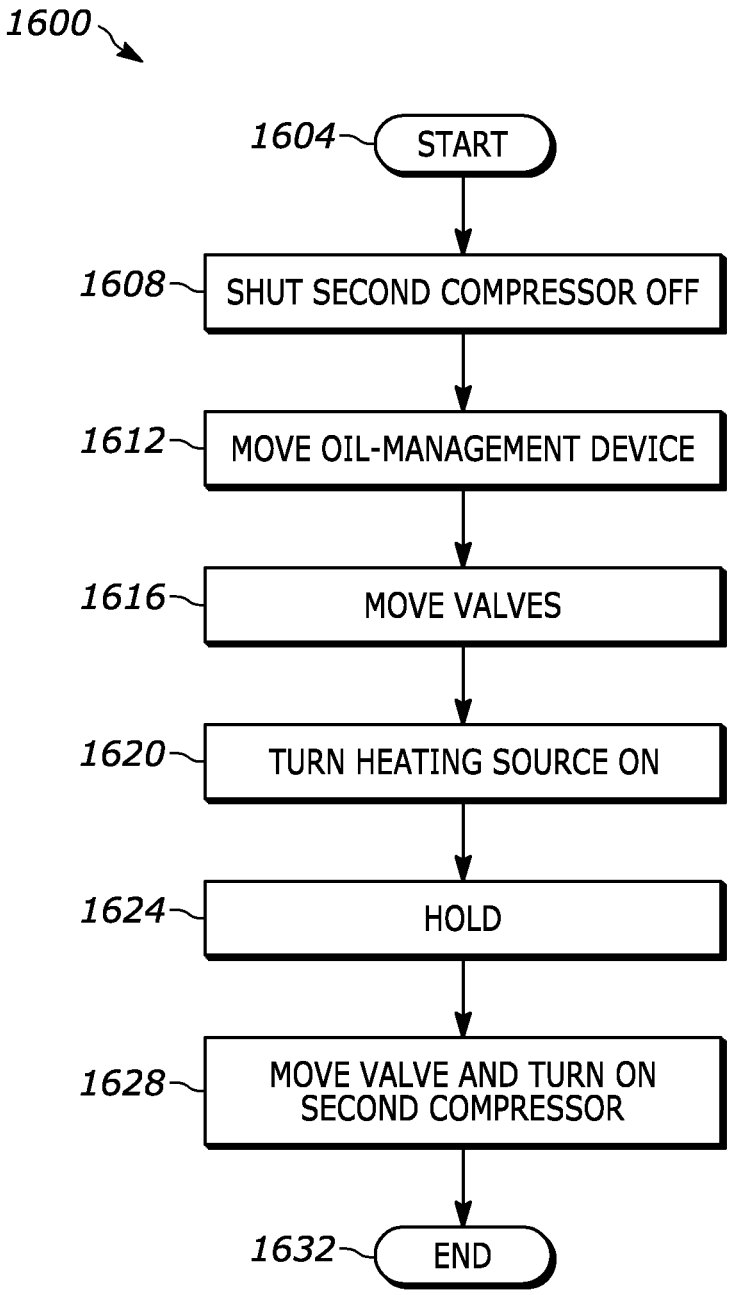
FIG. 26 is a flowchart depicting an algorithm for purging oil of one compressor to another compressor of the climate-control system of FIG. 24.

With reference to FIG. 26, a flowchart 1600 showing an example implementation of a control algorithm for oil purge in a refrigeration system is shown. The lubricant purge may be on a schedule such as during defrost, for example. The control algorithm begins at 1604. At 1608, the control algorithm, using the control module 1523 shuts the second compressor 1514 to an OFF-mode. After shutting the second compressor 1514 to the OFF-mode, the control algorithm then proceeds to 1612.

At 1612, the control algorithm, using the control module 1523, moves the device 1572 from a closed position to an open position. In this way, lubricant may exit the second compressor 1514 through the device 1572. After moving the device 1572 to the open positon, the control algorithm then proceeds to 1616.

At 1616, the control algorithm, using the control module 1523, moves the valve 1576 from the open position to the closed position, and one of the valve 1550 and the expansion device 1548 from an open position to a closed position. That is, if the device 1548 is an electronic expansion device, then the device 1548 is moved to the closed position, and if the device 1548 is a thermal expansion device, then the valve 1550 is moved to the closed position. In some configurations, when the pressure in the third heat exchanger 1520 is below a predetermined value at the time of shutting the second compressor 1514 to the OFF-mode, the one of the valve 1550 and the expansion device 1548 may be moved from an open position to a partially closed (e.g., 85% closed) for a period of time (e.g., 10 seconds or any other suitable time period) and then fully closed. This allows extra working fluid into the third heat exchanger 1520, which increases the pressure in the third heat exchanger 1520. It should be understood that the second compressor 1514 maybe shut to the OFF-mode, the device 1572 may be moved to the open position, and the valve 1576 and the one of the valve 1550 and the expansion device 1548 may be moved to the closed position simultaneously. After moving the valve 1576 to the closed position and the one of the valve 1550 and the expansion device 1548 to the closed position, the control algorithm then proceeds to 1620.

At 1620, the control algorithm, using the control module 1523, turns the heating source 1590 to an ON mode. This melts ice or frost formed on the coils of the third heat exchanger 1520, which increases the pressure in the third heat exchanger 1520. In some configurations, when the expansion device 1548 is a thermal expansion valve, the valve 1592 may be opened to introduce more liquid working fluid into the third heat exchanger 1520 (via the bypass passageway 1588), which further increases the pressure in the third heat exchanger 1520. It should be also understood that the valve 1592 may be opened to introduce more liquid fluid into the third heat exchanger 1520 before or after the heating source 1590 is turned to the ON mode. As the pressure increases in the third heat exchanger 1520, pressure in the second compressor 1514 also increases, which forces the lubricant therein out and into the second oil separator 1570 via the device 1572 and the second oil passageway 1574. After turning the heating source 1590 to the ON mode, the control algorithm then proceeds to 1624.

At 1624, the control algorithm, using the control module 1523, holds the device 1572 in the open position for a predetermined time period (e.g., 5 second, 10 seconds or any other suitable time period) or until the pressure in a suction line 1598 of the second compressor 1514 exceeds a predetermined value. The device 1572 may then be moved from the open position to the closed position. After holding the device 1572 in the open position for a predetermined time period or until the pressure in the suction line 1598 of the second compressor 1514 exceeds the predetermined value, the control algorithm proceeds to 1628.

At 1628, the control algorithm, using the control module 1523, moves the valve 1576 to the open position and turns the second compressor 1514 to an ON-mode upon receiving a demand signal from a thermostat, for example, disposed within a space to be cooled. The control module 1523 then proceeds to 1632 and ends.

Figure 27:
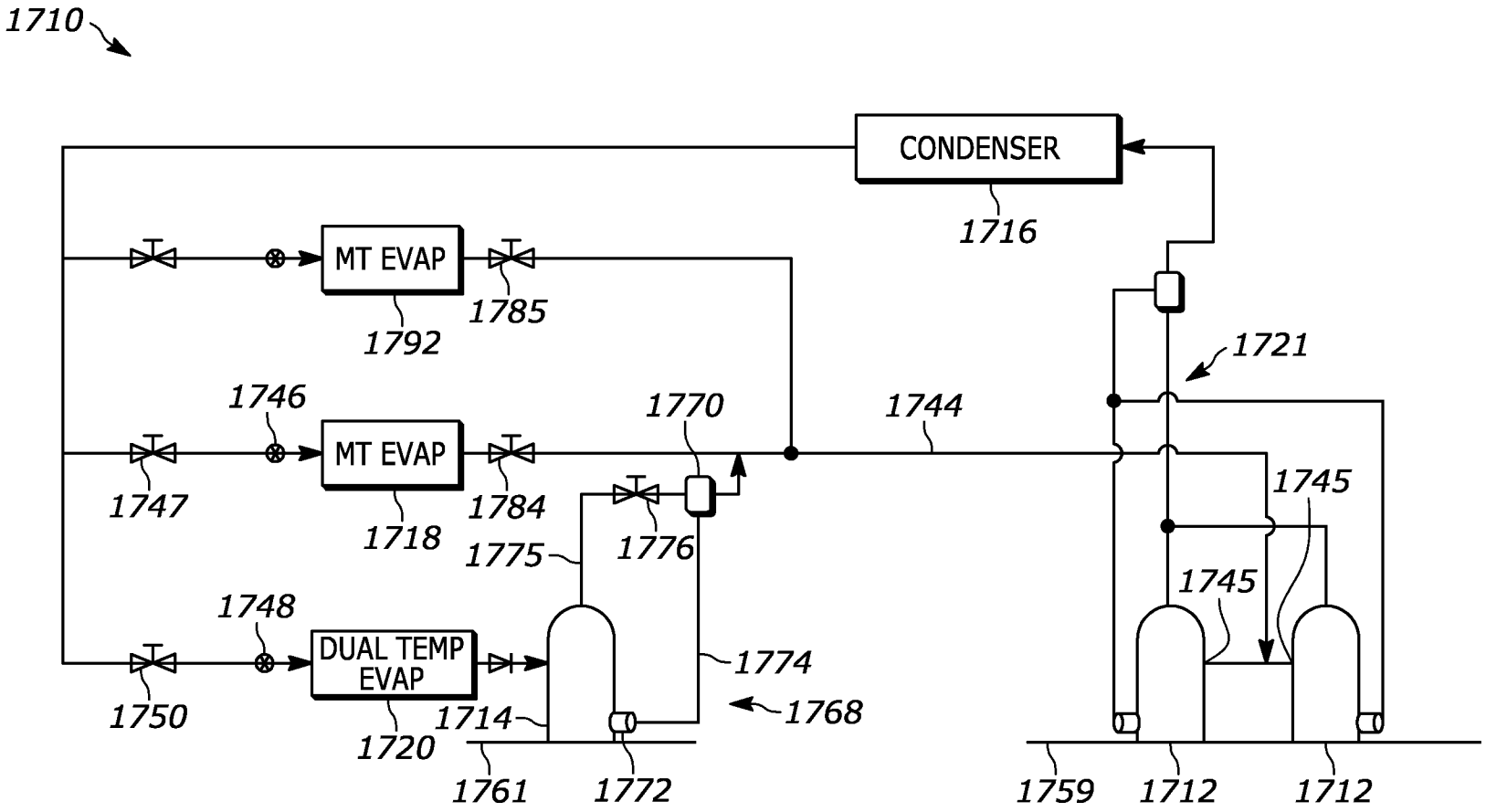
FIG. 27 is yet another schematic representation of a climate-control system.
Figure 28:
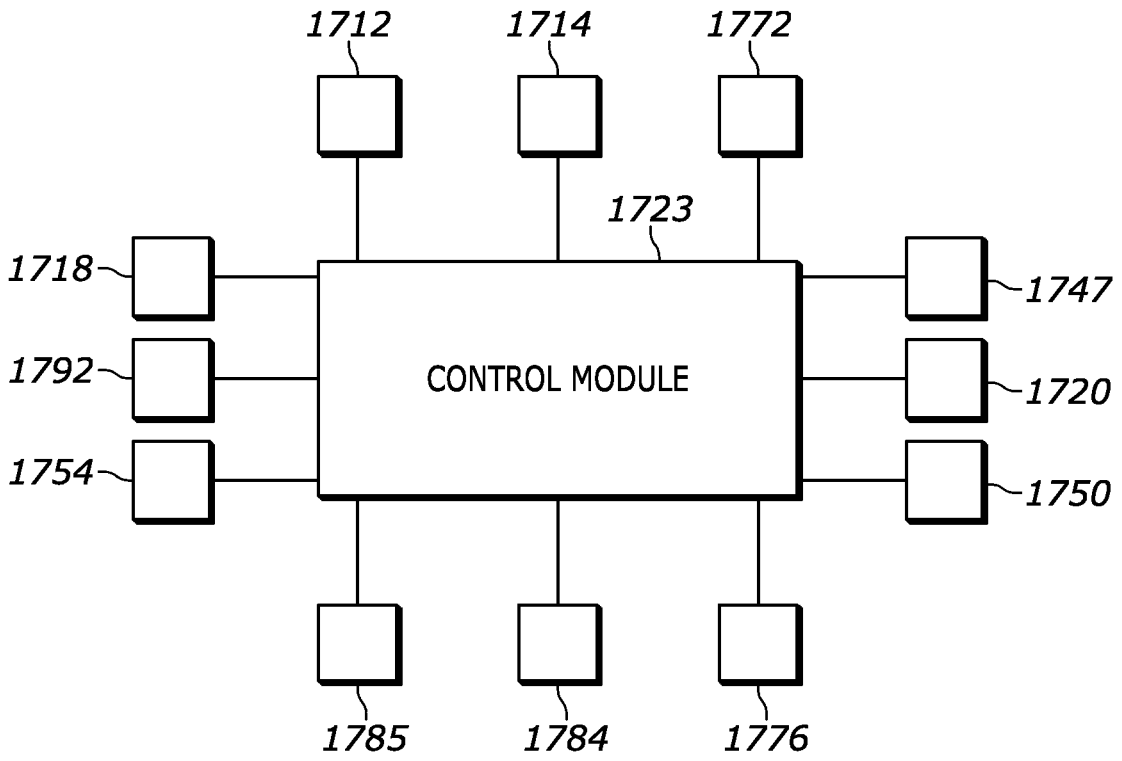
FIG. 28 is a block diagram illustrating communication between a control module and components of the climate-control system of FIG. 27.

With reference to FIGS. 27 and 28, another climate control system 1710 is provided that may be generally similar to the climate-control systems 1110 described above, apart from any exceptions noted below. The climate-control system 1710 may include a fluid-circuit having one or more first compressors 1712, one or more second compressors 1714 (e.g., a scroll compressor), a first heat exchanger 1716 (an outdoor heat exchanger such as a condenser or gas cooler, for example), a second heat exchanger 1718 (an indoor heat exchanger such as a medium-temperature evaporator, for example), a third heat exchanger 1720 (an indoor heat exchanger such as a dual temperature evaporator, for example), a fourth heat exchanger 1792 (an indoor heat exchanger such as a medium temperature evaporator, for example) and a control module 1723.

The structure and function of the first compressors 1712 may be similar or identical to that of the first compressors 1112 described above, and therefore, will not be described again in detail. The structure and function of the second compressor 1714 may be similar or identical to that of the second compressors 1114 described above, and therefore, will not be described again in detail. The structure and function of the first heat exchanger 1716 may be similar or identical to that of the heat exchanger 1116 described above, and therefore, will not be described again in detail. The structure and function of the second heat exchanger 1718 may be similar or identical to that of the heat exchanger 1118 described above, and therefore, will not be described again in detail. The structure and function of the fourth heat exchanger 1792 may be similar or identical to that of the heat exchanger 1192 described above, and therefore, will not be described again in detail. The control module 1723 may be similar or identical to that of the control module 1123 described above, and therefore, will not be described again in detail.

The structure and function of a first expansion device 1746 may be similar or identical to that of the expansion device 1146 described above, and therefore, will not be described again in detail. The structure and function of a second expansion device 1748 may be similar or identical to that of the expansion device 1148 described above, and therefore will not be described again in detail. The structure and function of a first valve 1747 may be similar or identical to that of the valves 1147 described above, and therefore, will not be described again in detail. The structure and function of a second valve 1750 may be similar or identical to that of the valve 1150 described above, and therefore, will not be described again in detail.

The first compressors 1712 may be on a base plate 1759 and the second compressor 1714 may be on a base plate 1761 that is at a remote location relative to the first compressors 1712. The climate-control system 1710 may also include a first oil apparatus 1721. The structure and function of the first oil apparatus 1721 may be similar or identical to that of the oil apparatus 1121 described above, and therefore, will not be described again in detail.

As described above, the third heat exchanger 1720 may be a dual temperature evaporator that is operable at a low temperature and at a medium temperature. When the dual temperature evaporator 1720 operates at a low temperature, the dual temperature refrigeration case is a freezer. When the dual temperature evaporator 1720 operates at a medium temperature, the dual temperature refrigeration case is a refrigerator. Control of the dual temperature evaporator 1720 can be achieved using a supervisory or other control (e.g., control module 1723) that can shut off the second compressor 1714. That is, when the dual temperature evaporator 1720 is operating at a medium temperature, the second compressor 1714 is shut off and working fluid exiting the dual temperature evaporator 1720 may flow through the second compressor 1714 to the first compressors 1712 (e.g., working fluid flows through leakage paths of the second compressor 1714 and to the first compressors 1712 via the discharge line 1775 of the second compressor 1714, a fluid passageway 1744 and suction inlets 1745 of the first compressors 1712). The control would also change the temperature range of the dual temperature evaporator 1720 and make the appropriate adjustments to the electronic expansion valve 1748 to control case temperature and proper superheat.

In some configurations, when the dual temperature evaporator 1720 is operating at the low temperature and the second compressor 1714 is tripped, for example, the dual temperature evaporator 1720 may continue to operate at the low temperature (i.e., refrigeration case may still act as a freezer) by lowering the setpoint of the first compressors 1712. That is, since the third heat exchanger 1720 is a dual temperature evaporator 1720, the third heat exchanger 1720 may operate at a higher temperature (e.g., around 23 F) for a predetermined time period (i.e., while the second compressor 1714 is being diagnosed and repaired) in which case the refrigeration case still acts as a freezer. In such configurations, the second and fourth heat exchangers 1718, 1792 maintain operation at the medium temperature and the control module 1723 may control operation of the first compressors 1712 (i.e., lowering setpoint).

A second oil apparatus 1768 may include an oil separator 1770, an oil-management valve device 1772 and an oil passageway 1774. The oil separator 1770 is disposed along the discharge line 1775 of the second compressor 1714 such that working fluid discharged from the second compressor 1714 passes through the oil separator 1770 and the lubricant (e.g., oil) therein is entrapped in the oil separator 1770. A valve 1776 is disposed along the discharge line 1775 of the second compressor 1714 upstream of the oil separator 1170 and is movable between open and closed positions.

The oil-management valve device 1772 is attached to the second compressor 1714 and is in fluid communication with an internal cavity (not shown) of the second compressor 1714. The structure and function of the device 1772 may be similar or identical to that of the device 1172 described above, and therefore, will not be described again in detail. The oil passageway 1774 extends from the oil separator 1770 to the device 1772. The structure and function of the oil passageway 1774 may be similar or identical to that of the oil passageway 1174 described above, and therefore, will not be described again in detail.

As shown in FIG. 28, the control module 1723 may be in communication with the first compressors 1712, the second compressor 1714, valves 1747, 1750, 1776, 1784, 1785, the devices 1754, 1772, and heat exchangers 1718, 1720, 1792, for example. The control module 1723 may control operation of the first compressors 1712, the second compressor 1714, the valves 1747, 1750, 1776, 1784, 1785, the devices 1754, 1772, and the heat exchangers 1718, 1720, 1792 based at least partially on lubricant levels within the first and second compressors 1712, 1714 and/or load requirements of the system 1710.

Figure 29:
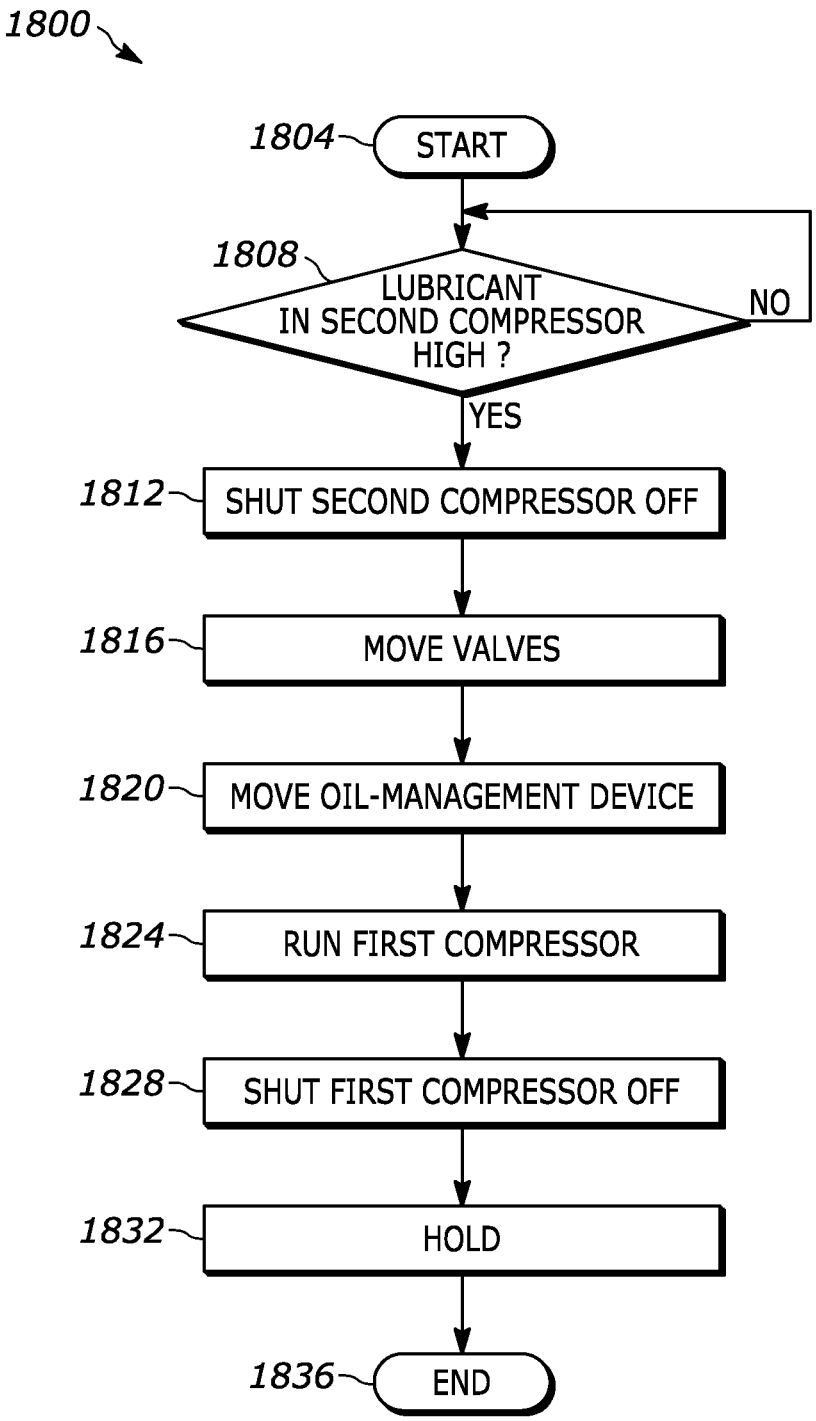
FIG. 29 is a flowchart depicting an algorithm for purging oil of one compressor to another compressor of the climate-control system of FIG. 27.

With reference to FIG. 29, a flowchart 1800 showing an example implementation of a control algorithm for oil purge in a refrigeration system is shown. The control algorithm begins at 1804. At 1808, the control algorithm, using the control module 1723 determines if lubricant in the second compressor 1714 is above a predetermined level. In some configurations, the lubricant purge may be on a schedule such as during defrost. If the lubricant in the second compressor 1714 is above a predetermined level, the control algorithm proceeds to 1812; otherwise, the control algorithm remains at 1808 until the lubricant in the second compressor 1714 is above a predetermined level.

At 1812, the control algorithm, using the control module 1723, shuts the second compressor 1714 to an OFF-mode. This causes the pressure in the second compressor 1714 and in the third heat exchanger 1720 to increase such that the pressure is equal or nearly equal to the pressure in the first compressors 1712. After shutting the second compressor 1714 to the OFF-mode, the control algorithm then proceeds to 1816.

At 1816, the control algorithm, using the control module 1723, moves the valves 1776, 1784, 1785 from the open position to the closed position and one of the valve 1750 and the expansion device 1748 from the open position to the closed position. That is, if the device 1748 is an electronic expansion device, then the device 1748 is moved to the closed position, and if the device 1748 is a thermal expansion device, then the valve 1750 is moved to the closed position. It should be understood that the valves 1776, 1784, 1785 and the one of the valve 1750 and the expansion device 1748 may be moved simultaneously or in a sequence (e.g., moving the valve 1776 to the closed position, then moving the valve 1784 to the closed position, then moving the valve 1785 to the closed position and finally moving the one of the valve 1750 and the expansion device 1748 to the closed position). After moving the valves 1776, 1784, 1785 and the one of the valve 1750 and the expansion device 1748, the control algorithm then proceeds to 1820.

At 1820, the control algorithm, using the control module 1723, moves the device 1772 to an open position. In some configurations, the device 1772 may be moved to the open position and the valves 1776, 1784, 1785 may be moved to the closed position simultaneously. After moving the device 1772 to the open positon, the control algorithm then proceeds to 1824.

At 1824, the control algorithm, using the control module 1723, runs the first compressors 1712 for a predetermined time period (e.g., 30 seconds, 1 minute or any other suitable time) or until the first compressors 1712 reaches a predetermined pressure setting. In this way, each of the first compressors 1712 pumps down such that the pressure in the first compressors 1712 drops below the pressure in the second compressor 1714. After running the first compressors 1712 for a predetermined time period or until the first compressor 1712 reaches a predetermined pressure setting, the control algorithm then proceeds to 1828.

At 1828, the control algorithm, using the control module 1723, shuts the first compressor 1712 to an OFF-mode. In this way, lubricant in the second compressor 1714 is purged out and into the oil separator 1770 via the device 1772 and the oil passageway 1774. That is, pressure of working fluid in the second compressor 1714 is greater than the pressure of working fluid in the first compressors 1712, which forces the lubricant out of the second compressor 1714 and into the second oil separator 1770. In the event that the second oil separator 1770 is omitted, the lubricant forced out of the second compressor 1714 will flow into the first compressors 1712 via the discharge line 1775 and the fluid passageway 1744. After shutting the first compressors 1712 to the OFF-mode, the control algorithm then proceeds to 1832.

At 1832, the control algorithm, using the control module 1723, holds the system in position (i.e., holds the valves 1776, 1784, 1785, the device 1772 and the one of the valve 1750 and the expansion device 1748 in the respective positions and the first and second compressors 1712, 1714 in the OFF-mode) for a predetermined time period (e.g., 5 second, 10 seconds or any other suitable time period) or until lubricant in the second compressor 1714 returns to a predetermined level. The system may then be returned to its normal state (i.e., the state that the valves 1776, 1784, 1785, the device 1772 and the one of the valve 1750 and the expansion device 1748 were originally positioned and starting the first and second compressors 1712, 1714). The control module 1723 then proceeds to 1836 and ends.

Figure 30:
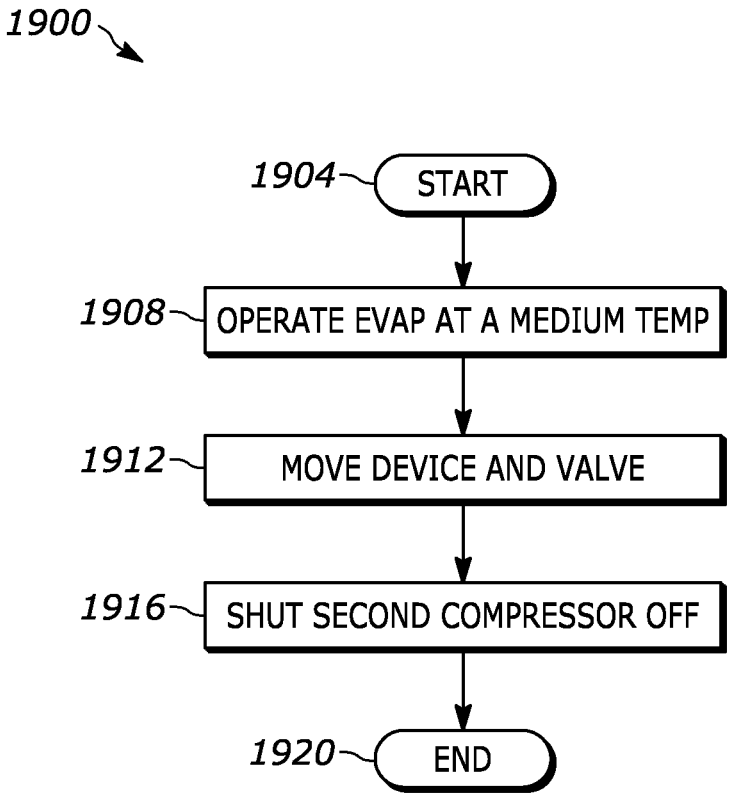
FIG. 30 is another flowchart depicting an algorithm for operating the dual temperature refrigeration case of the climate-control system of FIG. 27 in a medium temperature range.

With reference to FIG. 30, a flowchart 1900 showing an example implementation of a control algorithm for operating the dual temperature refrigeration case of a refrigeration system in a medium temperature range is shown. The control algorithm begins at 1904. At 1908, the control algorithm, using the control module 1723 operates the dual temperature evaporator 1720 at a medium temperature. After operating the dual temperature evaporator 1720 at the medium temperature, the control algorithm then proceeds to 1912.

At 1912, the control algorithm, using the control module 1723, moves the device 1772 in the closed position and moves the valve 1776 to the open position. In some configurations, the device 1772 can be moved to the closed position and the valve 1776 can be moved to the open position simultaneously with operating the dual temperature evaporator 1720 at the medium temperature. After moving the device 1772 and the valve, the control algorithm then proceeds to 1916.

At 1916, the control algorithm, using the control module 1723, shuts the second compressor 1714 to an OFF-mode. In this way, working fluid exiting the dual temperature evaporator 1720 flows through the second compressor 1714 and to the first compressors 1712 (working fluid flows through leakage paths of the second compressor 1714 and to the first compressors 1712 via the discharge line 1775 of the second compressor 1714, the fluid passageway 1744 and suction inlets 1745 of the first compressors 1712). One of the benefits of allowing working fluid exiting the dual temperature evaporator 1720 to flow through the second compressor 1714 when the dual temperature evaporator 1720 operates at a medium temperature (and the second compressor 1714 is shut OFF) is to avoid the need for piping such as a bypass passageway that bypasses the second compressor 1714. After shutting the second compressor 1714 to the OFF-mode, the control module 1723 then proceeds to 1920 and ends.

In this application, including the definitions below, the term "module" or the term "control module" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

In this application, apparatus elements described as having particular attributes or performing particular operations are specifically configured to have those particular attributes and perform those particular operations. Specifically, a description of an element to perform an action means that the element is configured to perform the action. The configuration of an element may include programming of the element, such as by encoding instructions on a non-transitory, tangible computer-readable medium associated with the element.

The apparatuses and methods described in this application may be partially or fully implemented by a special purpose computer created by configuring a general purpose computer to execute one or more particular functions embodied in computer programs. The figures and descriptions above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C #, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

None of the elements recited in the claims are intended to be a means-plus-function element within the meaning of 35 U.S.C. § 112(f) unless an element is expressly recited using the phrase "means for," or in the case of a method claim using the phrases "operation for" or "step for."

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method comprising:

receiving a lubricant purge command for a climate-control system having first and second compressors;

shutting the second compressor to an OFF-mode while the first compressor remains in an ON-mode in response to the lubricant purge command;

restricting working fluid from an outlet of the second compressor from flowing into the first compressor; and allowing compressed working fluid discharged from an outlet of the first compressor to flow into an inlet of the second compressor such that lubricant in the second compressor flows into the first compressor.

2. The method of claim 1, wherein the lubricant purge command is based on determining that the first compressor has a low lubricant level or the second compressor has a high lubricant level.

3. The method of claim 1, wherein a first oil-management valve device is in fluid communication with the second compressor and a second oil-management valve device is in fluid communication with the second compressor.

4. The method of claim 3, wherein the first and second oil-management valve devices are moved to an open position when the second compressor is shut to the OFF-mode.

5. The method of claim 4, wherein a passageway is in fluid communication with the first and second oil-management valve devices, and wherein lubricant flows from the second compressor into the first compressor via the passageway when compressed working fluid discharged from the outlet of the first compressor is allowed to flow into the inlet of the second compressor and the first and second oil-management valve devices are moved to the open position.

6. The method of claim 1, wherein the first and second compressors are on a base plate.

7. A method comprising:

receiving a lubricant purge command for a climate-control system having first and second compressors;

preventing working fluid exiting a condenser from flowing into an evaporator in response to the lubricant purge command;

shutting the second compressor to an OFF-mode;

drawing working fluid out of the evaporator using the first compressor and into a suction line in fluid communication with the evaporator and the first compressor; and shutting the first compressor to an OFF-mode such that lubricant flows from the first compressor into the second compressor.

8. The method of claim 7, wherein the lubricant purge command is based on determining that the first compressor has a low lubricant level.

9. The method of claim 7, wherein a first oil-management valve device is in fluid communication with the second compressor and a second oil-management valve device is in fluid communication with the second compressor.

10. The method of claim 9, wherein the first and second oil-management valve devices are moved to an open position when the first compressor is shut to the OFF-mode.

11. The method of claim 10, wherein a conduit is in fluid communication with the first and second compressors, and wherein lubricant flows from the second compressor into the first compressor via the conduit when the first compressor is shut to the OFF-mode and the first and second oil-management valve devices are moved to the open position.

12. The method of claim 7, wherein the first and second compressors are on a base plate.

13. The method of claim 7, wherein compressed working fluid discharged from an outlet of the second compressor flows into an inlet of the first compressor.

14. A method comprising:

receiving a lubricant purge command for a climate-control system having first and second compressors;

shutting the second compressor to an OFF-mode while the first compressor remains in an ON-mode in response to the lubricant purge command;

allowing working fluid discharged from a condenser to flow into an inlet of the second compressor; and restricting working fluid from an outlet of the second compressor from flowing into the first compressor such that lubricant in the second compressor flows into the first compressor.

15. The method of claim 14, wherein the lubricant purge command is based on determining that the first compressor has a low lubricant level or the second compressor has a high lubricant level.

16. The method of claim 14, wherein a first fluid passageway extends from an evaporator to the first compressor, and a second fluid passageway extends from a third fluid passageway at a location between the condenser and the evaporator to the inlet second compressor.

17. The method of claim 16, wherein a first oil-management valve device is in fluid communication with the second compressor and is movable between open and closed positions.

18. The method of claim 17, wherein an oil passageway extends from the first oil-management valve device to the first fluid passageway, and wherein lubricant flows from the second compressor to the first compressor via the oil passageway when working fluid exiting the condenser is allowed to flow into the inlet of the second compressor via the second fluid passageway and working fluid from the second compressor is restricted from flowing into the first compressor.

19. The method of claim 18, further comprising positioning an accumulator along the second fluid passageway to remove liquid working fluid flowing into the inlet of the second compressor.

20. A method comprising:

receiving a lubricant purge command for a climate-control system having first and second compressors;

restricting working fluid from an outlet of the second compressor from flowing into the first compressor in response to the lubricant purge command;

shutting the second compressor to an OFF-mode while the first compressor remains in an ON-mode; and allowing working fluid in a discharge line of the second compressor to flow back into the second compressor such that lubricant in the second compressor flows into the first compressor.

21. The method of claim 20, wherein the lubricant purge command is based on determining that the first compressor has a low lubricant level or the second compressor has a high lubricant level.

22. The method of claim 20, wherein a fluid passageway extends from an evaporator to the first compressor.

23. The method of claim 22, wherein an oil-management valve device is in fluid communication with the second compressor and is movable between open and closed positions.

24. The method of claim 23, wherein an oil passageway extends from the oil-management valve device to the fluid passageway, and wherein lubricant flows from the second compressor to the first compressor via the oil passageway when the second compressor is shut to the OFF-mode and working fluid in the discharge line of the second compressor is allowed to flow back into the second compressor.

25. A method comprising:

receiving a lubricant purge command for a climate-control system having first and second compressors;

shutting the second compressor to an OFF-mode;

preventing working fluid from an outlet of the second compressor from flowing into the first compressor;

preventing working fluid from an evaporator from flowing into the first compressor;

running the first compressor until the first compressor reaches a predetermined pressure setting; and shutting the first compressor to an OFF-mode after reaching the predetermined pressure setting such that lubricant flows from the second compressor into one of an oil separator and the first compressor.

26. The method of claim 25, wherein the lubricant purge command is based on determining that the second compressor has a high lubricant level.

27. The method of claim 26, wherein lubricant flows from the second compressor into the oil separator.

28. The method of claim 27, wherein an oil-management valve device is in fluid communication with the second compressor and is movable between open and closed positions, and wherein the oil-management valve device is moved from the closed position to the open position after the second compressor is shut to the OFF-mode.

29. The method of claim 27, wherein an oil passageway extends from the oil-management valve device to the oil separator disposed along a discharge line of the second compressor, and wherein lubricant flows from the second compressor to the oil separator via the oil-management valve device and the oil passageway.

30. The method of claim 29, wherein the oil separator is a bi-directional oil separator.

31. The method of claim 26, wherein lubricant flows from the second compressor into the first compressor.

32. The method of claim 31, wherein a fluid passageway extends from the evaporator to the first compressor, and wherein a discharge line extends from the outlet of the second compressor to the fluid passageway.

33. The method of claim 32, wherein an oil-management valve device is in fluid communication with the second compressor and is movable between open and closed positions, and wherein the oil-management valve device is moved from the closed position to the open position after the second compressor is shut to the OFF-mode.

34. The method of claim 33, wherein an oil passageway extends from the oil-management valve device to the discharge line, and wherein lubricant flows from the second compressor to the first compressor via the oil-management valve device, the oil passageway, and the fluid passageway.

35. A method comprising:

receiving a lubricant purge command for a climate-control system having first and second compressors;

shutting the second compressor to an OFF-mode while the first compressor remains in an ON-mode in response to the lubricant purge command;

allowing working fluid discharged from a condenser to flow into an inlet of the second compressor; and restricting working fluid from an outlet of the second compressor from flowing into the first compressor such that lubricant in the second compressor flows into an oil separator.

36. The method of claim 35, wherein the lubricant purge command is based on determining that the second compressor has a high lubricant level.

37. The method of claim 36, wherein an oil-management valve device is in fluid communication with the second compressor and is movable between open and closed positions, and wherein the oil-management valve device is moved from the closed position to the open position after the second compressor is shut to the OFF-mode.

38. The method of claim 37, wherein an oil passageway extends from the oil-management valve device to the oil separator disposed along a discharge line of the second compressor, and wherein lubricant flows from the second compressor to the oil separator via the oil-management valve device and the oil passageway.

39. The method of claim 38, wherein the oil separator is a bi-directional oil separator.

40. The method of claim 35, wherein a first fluid passageway extends from a second fluid passageway at a location between the condenser and an evaporator to the inlet of the second compressor.

41. The method of claim 40, further comprising positioning an accumulator along the first fluid passageway to remove liquid working fluid from flowing into the inlet of the second compressor.

42. A method comprising:

receiving a lubricant purge command for a climate-control system having first and second compressors;

shutting the second compressor to an OFF-mode;

selectively allowing working fluid discharged from a condenser to flow into an evaporator;

preventing working fluid from an outlet of the second compressor from flowing into the first compressor; and heating the evaporator such that lubricant in the second compressor flows into an oil separator.

43. The method of claim 42, wherein an oil-management valve device is in fluid communication with the second compressor and is movable between open and closed positions, and wherein the oil-management valve device is moved from the closed position to the open position when the second compressor is shut to the OFF-mode.

44. The method of claim 43, wherein an oil passageway extends from the oil-management valve device to the oil separator disposed along a discharge line of the second compressor, and wherein lubricant flows from the second compressor to the oil separator via the oil-management valve device and the oil passageway.

45. The method of claim 43, further comprising holding the oil-management valve device in the open position for a predetermined time period or until the pressure in a suction line of the second compressor exceeds a predetermined value.

46. The method of claim 44, wherein the oil separator is a bi-directional oil separator.

47. The method of claim 42, wherein working fluid discharged from the condenser is prevented from flowing into the evaporator when the second compressor is shut to the OFF-mode if pressure in the evaporator is above a predetermined value.

48. The method of claim 42, wherein working fluid discharged from the condenser is allowed to flow into the evaporator when the second compressor is shut to the OFF-mode if pressure in the evaporator is below a predetermined value.

49. The method of claim 48, wherein working fluid discharged from the condenser is allowed to flow into the evaporator after or before heating the evaporator.

50. The method of claim 48, wherein working fluid discharged from the condenser is allowed to flow into the evaporator for a predetermined period of time.

51. A method comprising:

providing first and second compressors of a climate control system, the second compressor configured to provide working fluid to the first compressor;

shutting the second compressor to an OFF-mode; and allowing working fluid exiting a heat exchanger to flow through the second compressor and into the first compressor while the second compressor is in the OFF-mode;

wherein the heat exchanger is a dual temperature evaporator operable at a low temperature and at a high temperature, and wherein the heat exchanger is operating at the high temperature when the second compressor is shut to the OFF-mode.

52. The method of claim 51, further comprising allowing working fluid exiting a medium temperature evaporator to flow to the first compressor, working fluid exiting the heat exchanger mixes with working fluid exiting the medium temperature evaporator as it flows to the first compressor.

53. The method of claim 52, wherein the heat exchanger is associated with a first space to be cooled and the medium temperature evaporator is associated with a second space to be cooled that is different from the first space.

54. The method of claim 51, wherein the second compressor is a scroll compressor.

* * * * *